US009181699B2

(12) United States Patent
Ciuperca

(10) Patent No.: US 9,181,699 B2
(45) **Date of Patent: *Nov. 10, 2015**

(54) PRECAST CONCRETE STRUCTURES, PRECAST TILT-UP CONCRETE STRUCTURES AND METHODS OF MAKING SAME

(71) Applicant: Romeo Ilarian Ciuperca, Norcross, GA (US)

(72) Inventor: Romeo Ilarian Ciuperca, Norcross, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/643,871

(22) Filed: Mar. 10, 2015

(65) Prior Publication Data

US 2015/0184388 A1 Jul. 2, 2015

Related U.S. Application Data

(63) Continuation of application No. 13/247,256, filed on Sep. 28, 2011, now Pat. No. 8,555,584, and a continuation of application No. 14/040,977, filed on Sep. 30, 2013, now Pat. No. 8,745,943, and a continuation of application No. 14/227,490, filed on Mar. 27, 2014, now Pat. No. 8,984,826.

(51) Int. Cl.

| | |
|---|---|
| ***E04B 1/00*** | (2006.01) |
| ***E04C 2/288*** | (2006.01) |
| ***E04B 1/35*** | (2006.01) |
| ***E04C 2/04*** | (2006.01) |
| ***E04G 21/16*** | (2006.01) |
| ***E04C 2/20*** | (2006.01) |
| ***E04B 1/14*** | (2006.01) |
| ***E04C 2/22*** | (2006.01) |
| ***E04C 2/24*** | (2006.01) |
| ***E04B 2/86*** | (2006.01) |
| ***E04C 2/06*** | (2006.01) |
| ***E04F 13/04*** | (2006.01) |

(Continued)

(52) U.S. Cl.

CPC . *E04C 2/288* (2013.01); *E04B 1/14* (2013.01); *E04B 1/355* (2013.01); *E04B 2/8647* (2013.01); *E04C 2/044* (2013.01); *E04C 2/06* (2013.01); *E04C 2/205* (2013.01); *E04C 2/22* (2013.01); *E04C 2/243* (2013.01); *E04F 13/045* (2013.01); *E04F 13/077* (2013.01); *E04F 13/0873* (2013.01); *E04G 21/16* (2013.01); *E04G 21/165* (2013.01); *E04B 2103/02* (2013.01); *E04F 13/0803* (2013.01); *Y10T 428/24926* (2015.01)

(58) Field of Classification Search

CPC ..... E04B 2/8641; E04B 2/8617; E04B 2002/8694; E04B 2/8635; E04B 2002/867; E04B 2/8652; E04B 2/8647; Y10T 24/4501; E04C 2002/047; E04C 2/288; E04C 5/168; E04C 2002/045; E04C 2/044

See application file for complete search history.

(56) References Cited

U.S. PATENT DOCUMENTS

| | | | |
|---|---|---|---|
| 2,053,135 | A | 9/1936 | Dalton |
| 3,199,828 | A | 8/1965 | Newton |

(Continued)

*Primary Examiner* — Brian Glessner
*Assistant Examiner* — Gisele Ford
(74) *Attorney, Agent, or Firm* — Richards IP Law; Robert E. Richards

(57) ABSTRACT

The invention comprises a method of forming a concrete structure. The method comprises placing plastic concrete in a form of a desired shape, encasing the concrete in insulating material having insulating properties equivalent to at least 1 inch of expanded polystyrene and allowing the plastic concrete to at least partially cure inside the insulating material. An insulated concrete form and a method of using the insulated concrete form are also disclosed.

21 Claims, 15 Drawing Sheets

(51) Int. Cl.
*E04F 13/077* (2006.01)
*E04F 13/08* (2006.01)

(56) References Cited

U.S. PATENT DOCUMENTS

| | | | |
|---|---|---|---|
| 3,649,725 | A | 3/1972 | Olson |
| 3,732,138 | A | 5/1973 | Almog |
| 3,892,516 | A | 7/1975 | McGrew et al. |
| 3,985,329 | A | 10/1976 | Liegens |
| 4,052,031 | A | 10/1977 | Melfi |
| 4,085,495 | A | 4/1978 | Hebert |
| 4,090,336 | A | 5/1978 | Carroll |
| 4,157,638 | A | 6/1979 | Della-Donna |
| 4,349,398 | A | 9/1982 | Kearns et al. |
| 4,370,840 | A | 2/1983 | Bisbee et al. |
| 4,462,949 | A | 7/1984 | Fehlmann |
| 4,516,372 | A | 5/1985 | Grutsch |
| 4,534,924 | A | 8/1985 | Kariakin |
| 4,646,498 | A | 3/1987 | Schneller et al. |
| 4,669,234 | A | 6/1987 | Wilnau |
| 4,744,849 | A | 5/1988 | Michaud-Soret |
| 4,765,109 | A | 8/1988 | Boeshart |
| 4,811,927 | A | 3/1989 | Slonimsky et al. |
| 4,866,897 | A | 9/1989 | Yount |
| 4,885,888 | A | 12/1989 | Young |
| 4,889,310 | A | 12/1989 | Boeshart |
| 4,907,386 | A | 3/1990 | Ekroth |
| 5,107,648 | A | 4/1992 | Roby |
| 5,171,118 | A | 12/1992 | Rothenbuhler |
| 5,217,339 | A | 6/1993 | O'Connor et al. |
| 5,323,578 | A | 6/1994 | Chagnon et al. |
| D357,855 | S | 5/1995 | Keith et al. |
| 5,493,837 | A | 2/1996 | Hepler |
| 5,497,592 | A | 3/1996 | Boeshart |
| 5,570,550 | A | 11/1996 | Roby |
| 5,606,832 | A | 3/1997 | Keith et al. |
| 5,611,182 | A | 3/1997 | Spude |
| 5,761,874 | A | 6/1998 | Hayakawa |
| 5,765,318 | A | 6/1998 | Michelsen |
| 5,792,552 | A | 8/1998 | Langkamp et al. |
| 5,809,723 | A | 9/1998 | Keith et al. |
| 5,809,725 | A | 9/1998 | Cretti |
| 5,809,726 | A | 9/1998 | Spude |
| 5,809,728 | A | 9/1998 | Tremelling |
| 5,819,489 | A | 10/1998 | McKinney |
| 5,836,126 | A | 11/1998 | Harkenrider et al. |
| 5,966,885 | A | 10/1999 | Chatelain |
| 5,992,114 | A | 11/1999 | Zelinsky et al. |
| 6,026,620 | A | 2/2000 | Spude |
| 6,086,349 | A | 7/2000 | Del Monte |
| 6,134,861 | A | 10/2000 | Spude |
| 6,138,981 | A | 10/2000 | Keith et al. |
| 6,234,736 | B1 | 5/2001 | Miescher |
| 6,263,638 | B1 | 7/2001 | Long, Sr. |
| 6,305,135 | B1 | 10/2001 | Inaba |
| 6,314,694 | B1 | 11/2001 | Cooper et al. |
| 6,360,505 | B1 | 3/2002 | Johns |
| 6,426,029 | B1 | 7/2002 | Hiscock et al. |
| 6,612,083 | B1 | 9/2003 | Richards |
| 6,688,066 | B1 | 2/2004 | Cottier et al. |
| 6,725,616 | B1 | 4/2004 | Pease |
| 6,729,090 | B2 | 5/2004 | Messenger et al. |
| 6,898,908 | B2 | 5/2005 | Messenger et al. |
| 6,898,912 | B2 | 5/2005 | Bravinski |
| 6,935,081 | B2 | 8/2005 | Dunn et al. |
| 7,000,359 | B2 | 2/2006 | Meyer |
| 7,398,131 | B2 | 7/2008 | Trost et al. |
| 7,409,800 | B2 | 8/2008 | Budge |
| 7,765,761 | B2 | 8/2010 | Paradis |
| 7,818,935 | B2 | 10/2010 | Velickovic |
| 7,934,693 | B2 | 5/2011 | Bravinski |
| 8,032,244 | B2 | 10/2011 | Trost et al. |
| 8,532,815 | B1 | 9/2013 | Ciuperca |
| 8,545,749 | B2 | 10/2013 | Ciuperca |
| 8,555,583 | B2 | 10/2013 | Ciuperca |
| 8,555,584 | B2 | 10/2013 | Ciuperca |
| 8,636,941 | B1 | 1/2014 | Ciuperca |
| 8,745,943 | B2 | 6/2014 | Ciuperca |
| 8,756,890 | B2 | 6/2014 | Ciuperca |
| 8,844,227 | B1 | 9/2014 | Ciuperca |
| 8,855,803 | B2 | 10/2014 | Ciuperca |
| 8,877,329 | B2 | 11/2014 | Ciuperca |
| 8,966,845 | B1 | 3/2015 | Ciuperca |
| 2002/0005725 | A1 | 1/2002 | Scott |
| 2002/0092253 | A1 | 7/2002 | Beliveau |
| 2003/0192272 | A1 | 10/2003 | Bravinski |
| 2004/0129857 | A1 | 7/2004 | Musk et al. |
| 2005/0108985 | A1 | 5/2005 | Bravinski |
| 2007/0062143 | A1 | 3/2007 | Noushad |
| 2007/0095255 | A1 | 5/2007 | Abbate et al. |
| 2007/0144653 | A1 | 6/2007 | Padilla et al. |
| 2008/0041004 | A1 | 2/2008 | Gibbar et al. |
| 2008/0173788 | A1 | 7/2008 | Brewka et al. |
| 2008/0313991 | A1 | 12/2008 | Chouinard |
| 2009/0202307 | A1 | 8/2009 | Au et al. |
| 2009/0218474 | A1 | 9/2009 | Bowman |
| 2009/0277103 | A1 | 11/2009 | De Jaham |
| 2010/0062667 | A1 | 3/2010 | Pan et al. |
| 2010/0162659 | A1 | 7/2010 | Laprise |
| 2010/0192498 | A1 | 8/2010 | Gleckman |
| 2010/0232877 | A1 | 9/2010 | Sanvik et al. |
| 2010/0319295 | A1 | 12/2010 | Nelson |
| 2011/0057090 | A1 | 3/2011 | Spude et al. |
| 2011/0239566 | A1 | 10/2011 | Ciuperca |
| 2012/0058299 | A1 | 3/2012 | Serwin |
| 2013/0074432 | A1 | 3/2013 | Ciuperca |
| 2013/0074433 | A1 | 3/2013 | Ciuperca |
| 2013/0119576 | A1 | 5/2013 | Ciuperca |
| 2014/0041329 | A1 | 2/2014 | Ciuperca |
| 2014/0083333 | A1 | 3/2014 | Ciuperca |
| 2014/0084132 | A1 | 3/2014 | Ciuperca |
| 2014/0087158 | A1 | 3/2014 | Ciuperca |
| 2014/0088756 | A1 | 3/2014 | Ciuperca |
| 2014/0174647 | A1 | 6/2014 | Ciuperca |
| 2014/0212643 | A1 | 7/2014 | Ciuperca |
| 2014/0260034 | A1 | 9/2014 | Ciuperca |
| 2014/0263942 | A1 | 9/2014 | Ciuperca |
| 2014/0272302 | A1 | 9/2014 | Ciuperca |
| 2014/0312524 | A1 | 10/2014 | Ciuperca |
| 2014/0332658 | A1 | 11/2014 | Ciuperca |
| 2014/0333004 | A1 | 11/2014 | Ciuperca |
| 2014/0333010 | A1 | 11/2014 | Ciuperca |
| 2015/0007524 | A1 | 1/2015 | Ciuperca |
| 2015/0014300 | A1 | 1/2015 | Ciuperca |

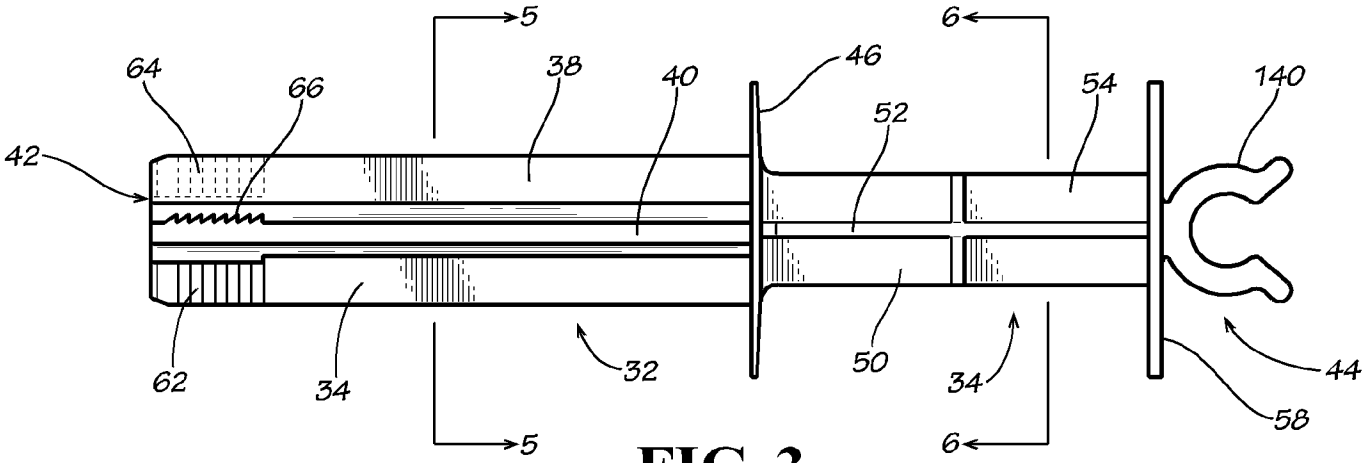
FIG. 3
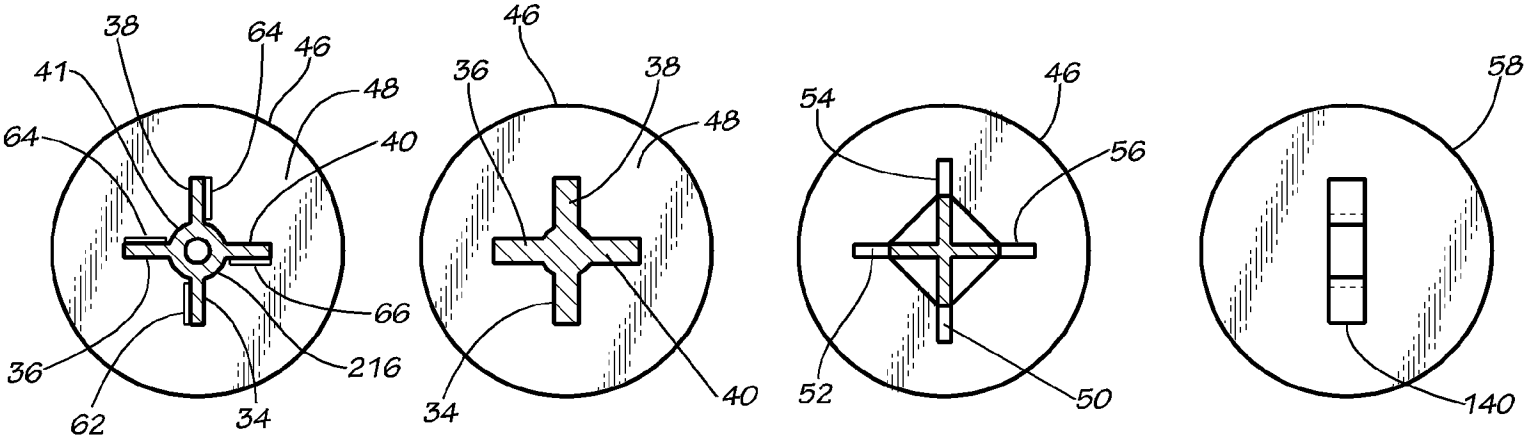
FIG. 7
FIG. 6
FIG. 5
FIG. 4

PRECAST CONCRETE STRUCTURES, PRECAST TILT-UP CONCRETE STRUCTURES AND METHODS OF MAKING SAME

CROSS-REFERENCE TO RELATED APPLICATIONS

The resent application is a continuation of a application Ser. No. 14/227,490 filed Mar. 27, 2014, now U.S. Pat. No. 8,984,826, which is a continuation of application Ser. No. 14/040,977 filed Sep. 30, 2013, now U.S. Pat. No. 8,745,943, which is a continuation of application Ser. No. 13/247,256 filed Sep. 28, 2011, now U.S. Pat. No. 8,555,584.

FIELD OF THE INVENTION

The present invention generally relates to the forming of concrete structures. More particularly, this invention relates to precast concrete structures, especially precast tilt-up concrete panels. The present invention also relates to insulated precast tilt-up concrete panels. The present invention also relates to a system for curing concrete more quickly. The present invention further relates to a high efficiency building system that reduces energy consumption. The present invention also related to a concrete structure that has a longer useful life than conventional concrete structures. The present invention also relates to methods of making precast concrete structures and precast tilt-up concrete structures, especially tilt-up concrete panels.

BACKGROUND OF THE INVENTION

Precast tilt-up, cast on site or off site, (also known as precast tilt-slab or tilt-wall) concrete construction is not new; it has been in use since the turn of the century. Since the mid-1940s it has developed into the preferred method of construction for many types of buildings and structures in the U.S. Precast concrete construction has many advantages that are well know in the art. The precast concrete panels can significantly reduce the initial cost of construction, increase the life of the structure and provide a relatively low-cost, low-maintenance building envelope. Depending on the size and type of application, such precast panels can be fabricated and stored offsite then delivered just in time for erection and installation. They can also be made on the construction site thereby eliminating relatively expensive transportation costs.

After concrete footings and a concrete slab have been poured and properly cured, a precast tilt-up concrete structural panel can be formed on the concrete slab. In tilt-up concrete construction, vertical concrete elements, such as walls, columns, structural supports, and the like, are formed horizontally on a concrete slab; usually the building floor, but sometimes on a temporary concrete casting surface near the building footprint. After the concrete has cured, the elements are tilted from horizontal to vertical with a crane and braced into position until the remaining building structural components are secured. In the same way the precast concrete panels can be formed in an offsite location using various types of forms well known in the art. After curing the precast and cured panels are transported to the building site and erected by means and methods well known in the art.

Construction of a precast concrete wall panel is begun by carefully planning out the size and shape of the wall panel on a suitable surface, such as the concrete slab (i.e., floor) of the building being constructed. Wooden concrete forms, usually made from 1× or 2> lumbar, are constructed on the perimeter of the proposed concrete wall. Typically, the wall panel depth (i.e., thickness) is designed to fit the depth of standard dimension lumbar, such as 5½-inch or 7¼-inch thick structural panels. Form sides are supported and secured to the concrete slab by wood or steel angle supports. Door and/or window openings can be formed after the perimeter framing is completed. A form release agent and bond breaker is then applied to the concrete slab and to panel forms in accordance with manufacturer recommendations.

After the form is constructed, a grid of steel rebar is constructed and tied in-place within the form to reinforce the structural panel. Plastic or metal support chairs are used to support the rebar grid at a proper depth. Embeds and inserts can be attached to the side forms or to the rebar grid. Embeds are used to attach the structural panel to footings, other panels, columns, slabs, roof systems, or attachment of building accessories. Inserts provide attachment points for lifting hardware and temporary braces.

Before concrete is placed in the form, the slab or casting surface must be cleaned and a release bond breaking agent is applied to prevent the panel from bonding to the casting surface. Regardless of the type of bond breaking agent used, there is always a certain amount of bond formed between the precast panel and the casting surface that must be broken before the panels will separate from the casting surface. Additional steel reinforcement is factored in so that the concrete panels can be lifted in place without damage. Concrete is then placed in the form in the same manner as floor slabs. The concrete is usually consolidated to ensure good flow around the steel rebar grid. Then, the concrete surface can be finished in any desired manner, such as trowel finish or other types of architectural finishes and patterns.

Since conventional precast concrete panels are exposed to the ambient temperature, the concrete temperature changes hourly and/or daily depending on the weather. These constant temperature changes cause internal stress in the curing concrete due to the expansion and contraction generated by the temperature changes. Such internal stress can cause cracking or microcracking. As a result, the life expectancy of the concrete structure is reduced. Additional steel reinforcement is often necessary to compensate for this expansion and contraction.

Precast tilt-up concrete panels have a large thermal mass exposed to ambient temperatures. They retain the heat in the summer or the cold in the winter very well. Therefore, precast tilt-up concrete buildings generally have relatively poor energy efficiency. Such buildings usually require a relatively large amount of energy to keep them warm in the winter and cool in the summer. Since most precast concrete panels are not insulated, they can receive insulation on the inside through the use of furring systems or on the outside with EIFS. More recently, new methods of insulating precast concrete panels have been employed. One of the most effective methods of insulating tilt-up concrete walls, however, is the method known as "sandwich" insulation. This method involves placing a layer of insulation between a structural concrete layer and an architectural or non-structural concrete layer during the casting of the panel and then tilting this entire composite construction as a panel. While this method improves the insulating properties of the wall and therefore the energy efficiency of the building, it has several drawbacks. Instead of having one layer of concrete, the "sandwich" creates two; one that is structural with the larger thermal mass that faces the inside of the building and is insulated from the elements. The second layer of concrete is thinner and placed on the exterior of the building; i.e., on side of the panel opposite the insulated structural layer. It is easy to see why it is more expensive and time consuming to cast concrete using this method. Also, since there is still a significant amount of concrete in the outside layer exposed to the ambient temperatures, the "sandwich" system does not perform as energy efficiently as it was expected.

Before the precast tilt-up concrete panel can be transported to the building site or erected into place, the concrete must achieve a desired minimum degree of strength. A precast tilt-up wall panel with low concrete compressive strength is more susceptible to failure by erection stresses. Therefore, it is important to know the compressive strength of the concrete at the time of erection. It is normal to have a minimum concrete compressive strength of 2,500 psi (18 MPa) before the titling operation begins; preferably 4,000 psi. For conventional Portland cement-based concrete, without additives to increase compressive strength, sufficient compressive strength is usually reached in five to seven days. However, depending on the weight of the panel being lifted, it may be necessary to change the concrete mix design to provide a stronger concrete compressive strength. Moreover, early concrete compressive strength is significantly affected by environmental conditions at the work site, especially temperature variations. In the construction industry, time is money. Thus, contractors frequently resort to the use of expensive concrete additives to make sure that the concrete has sufficient early strength to endure the stresses of erection.

The insulation of tilt-up concrete panels has not been dealt with extensively. In fact, few practical systems exist for insulating tilt-up concrete panels. U.S. Patent Application Publication No. 2008/0313991 discloses one system for insulating tilt-up concrete panels (the disclosure of which is incorporated herein by reference). This system uses panels of molded expanded polystyrene or extruded expended polystyrene to form the bottom surface of a horizontal mold for a tilt-up concrete panel. The foam insulating panels include dovetail-shaped grooves into which plastic concrete will flow, thereby attaching the foam insulating panels to the cured concrete panel. During the hoisting of the precast tilt-up concrete panels to a vertical position, a certain amount of deflection takes place in the panels. This deflection may cause the foam to come loose. Also, there is no mechanical attachment or reinforcement of the foam to the concrete. This system is not entirely desirable because, among others, it does not provide a system for a secure attachment of the foam to the concrete panels during hoisting or the life of the building. Also, it does not provide a system for attaching different types of exterior finishes or cladding and it does nothing to improve the physical properties of the concrete panel.

Therefore, it would be desirable to produce a precast concrete molding system for tilt-up concrete panels that allows concrete to achieve the maximum compressive strength possible in the shortest amount of time in any season and any type of weather and to be erected more quickly than prior art tilt-up concrete systems. It would also be desirable to provide a system for relatively easily and efficiently insulating tilt-up concrete panels or other structures to achieve the highest energy efficiency possible. It would also be desirable to provide an integrated precast concrete tilt-up system that provides for the installation of all types of exterior finishes or cladding systems to tilt-up insulated concrete panels.

SUMMARY OF THE INVENTION

The present invention satisfies the foregoing needs by providing an improved precast concrete tilt-up construction system.

In one disclosed embodiment, the present invention comprises a method of making a tilt-up concrete structure. The method comprises forming a horizontal mold of a desired shape for the precast tilt-up concrete structure, the mold having sides, a bottom and an open top and forming the bottom of the mold from a first insulating material having insulating properties equivalent to at least 1 inch of expanded polystyrene foam. The method also comprises placing a plastic concrete mix in the mold and on top of the first insulating material, the concrete having a top surface opposite the first insulating material and finishing the top surface of the plastic concrete mix in the mold. The method further comprises placing a second insulating material on the top surface of the finished concrete, the second insulating material having insulating properties equivalent to at least 1 inch of expanded polystyrene. The method also comprises allowing the concrete mix to partially cure in the mold until it has sufficient compressive strength to withstand the stress of being raised from its horizontal position to a vertical position; removing the mold sides and second insulating material; and raising the partially cured concrete structure from its horizontal position to a vertical position. In another disclosed embodiment, the first insulating material has an upper surface and the first insulating material has a plurality of anchor members attached thereto such that a portion of each anchor member extends upwardly from the upper surface of the first insulating material and such that the anchor members become attached to the concrete in the mold after it is at least partially cured, and such that the first insulating material is mechanically attached to the partially cured concrete structure when it is raised.

In another disclosed embodiment, the present invention comprises a horizontal form for constructing a tilt-up concrete structure. The form comprises vertical side members defining a concrete receiving space and a first insulating material defining a form bottom surface upon which plastic concrete is placed, the first insulating material having insulating properties equivalent to at least 1 inch of expanded polystyrene. The form also comprises a second insulating material defining a form top, the second insulating material being disposed on top of concrete in the form, the second insulating material having insulating properties equivalent to at least 1 inch of expanded polystyrene. The form further comprises a third insulating material disposed adjacent the vertical side members, the third insulating material having insulating properties equivalent to at least 1 inch of expanded polystyrene.

In another disclosed embodiment, the present invention comprises a method of forming a concrete structure. The method comprises placing plastic concrete in a form of a desired shape; encasing the concrete in insulating material having insulating properties equivalent to at least 1 inch of expanded polystyrene; and allowing the plastic concrete to at least partially cure inside the insulating material.

Accordingly, it is an object of the present invention to provide an improved concrete tilt-up construction system.

Another object of the present invention is to provide an improved precast composite concrete tilt-up construction system.

A further object of this present invention to provide a method of constructing a highly energy efficient building envelope.

Another object of the present invention is to provide an improved method for making a concrete structure.

A further object of the present invention is to provide an improved form for a precast concrete tilt-up panel.

Another object of the present invention is to provide an improved insulated precast concrete tilt-up panel.

Another object of the present invention is to provide a precast concrete tilt-up panel whereby the expansion and contraction due to the temperature changes is significantly reduced, or eliminated, thereby reducing the internal stress in the curing concrete thereby reducing the amount of reinforcement necessary within the panel.

A further object of the present invention is to provide a precast concrete tilt-up panel whereby the expansion and contraction due to the temperature changes is significantly reduced or eliminated, thereby reducing the internal stress in the curing concrete thereby increasing the useful life span of the structure.

A further object of the present invention is to provide a tilt-up concrete panel with a system for attaching cladding systems thereto.

Yet another object of the present invention is to provide a precast tilt up concrete systems that can be cast on any level, solid surface.

A further object of this present invention is to eliminate the bond formed between the concrete panels and the casting surface, thereby reducing the amount of energy required to break such a bond and thereby reducing the size of the lifting equipment required to lift the panels.

Still another object of the present invention is to provide an tilt-up insulated concrete panel with a system for applying decorative finishes to the insulated surface thereof.

Another object of the present invention is to provide a tilt-up concrete forming system that allows the tilt-up concrete panel to be erected more quickly than prior art systems.

Another object of the present invention is to provide an improved precast concrete construction system.

These and other objects, features and advantages of the present invention will become apparent after a review of the following detailed description of the disclosed embodiments and the appended drawing and claims.

BRIEF DESCRIPTION OF THE DRAWINGS

FIG. 3 is a side view of the anchor member shown in FIG. 2 FIG. 4 is an end view of the anchor member shown in FIG. 3, showing the locking teeth.

FIG. 5 is a cross-sectional view taken along the line 5-5 of the anchor member shown in FIG. 3.

FIG. 6 is a cross-sectional view taken along the line 6-6 of the anchor member shown in FIG. 3.

FIG. 7 is an end view of the anchor member shown in FIG. 3, showing the C-shaped clamping member/rebar chair.

DETAILED DESCRIPTION OF THE DISCLOSED EMBODIMENTS

Figure 1:
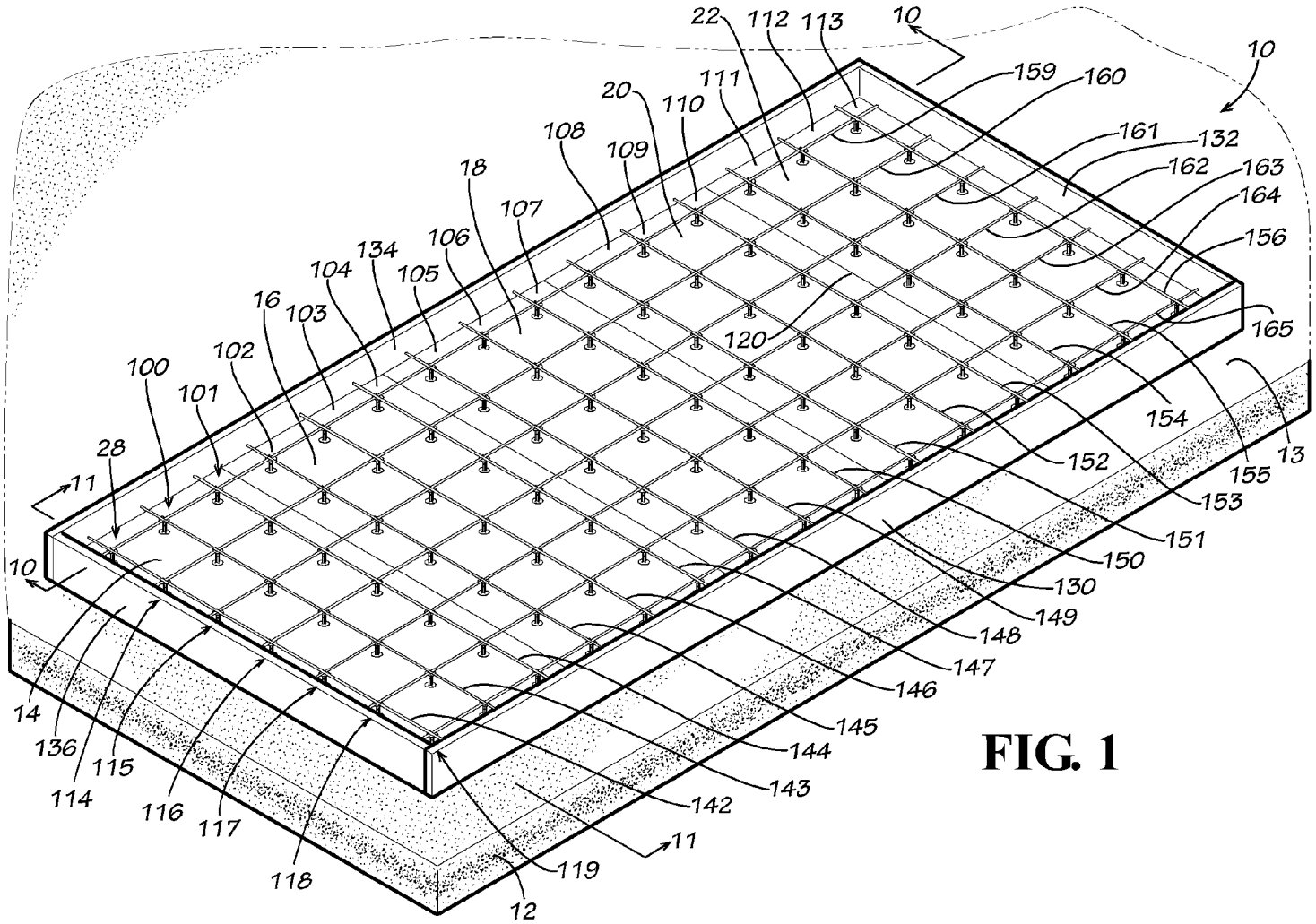
FIG. 1 is a perspective view of an insulated concrete form for a tilt-up concrete panel in accordance with a disclosed embodiment of the present invention.
Figure 10:
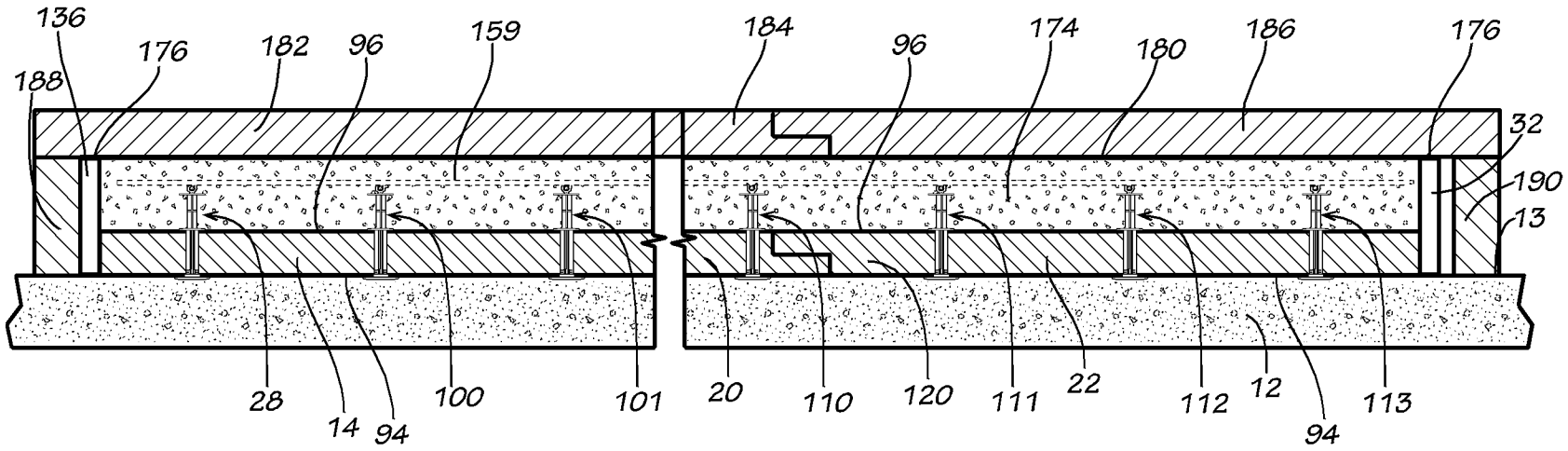
FIG. 10 is a cross-sectional view taken along the line 10-10 of the insulated concrete form shown in FIG. 1 additionally showing concrete in the form and foam insulating panels on the top and sides of the form.

Referring now to the drawing in which like numbers indicate like elements throughout the several views, there is shown in FIG. 1 a disclosed embodiment of a tilt-up insulated concrete form 10 in accordance with the present invention. The tilt-up insulated concrete form 10 rests horizontally on a previously formed, and at least partially cured, concrete slab 12, which forms a floor of a proposed building (not shown). Alternately, the insulated concrete form 10 can be used on any solid, level, casting surface. The concrete slab 12 has a horizontal flat upper surface 13. The tilt-up insulated concrete form 10 includes a plurality of rectangular foam insulating panels, such as the foam insulating panels 14, 16, 18, 20, 22. The foam insulating panels 14-22 are any suitable size, but in this disclosed embodiment are each 4 feet wide and 10 feet long. When the foam insulating panels 14-22 are adhesively joined together side-by-side as shown in FIGS. 1 and 10, they form a larger foam insulating panel, which in this disclosed embodiment is a panel 10 wide and 20 feet long. Of course, any size concrete panel can be constructed in accordance with the present invention by using foam insulating panels of different sizes or a larger or smaller number of such panels. This is a size of a tilt-up concrete panel that may be used for building a two-story high warehouse building, such as a home building supply store or a warehouse grocery store/general merchandise store. The foam insulating panels 14-22 can be made from any insulating material that is sufficiently rigid to withstand the pressures of the concrete placed in the form and from workers walking on the foam insulating panels. The foam insulating panels 14-22 preferably are made from a polymeric foam material, such as molded expanded polystyrene or extruded expanded polystyrene. Other polymeric foams can also be used, such as polyisocyanurate or polyurethane. The foam insulating panels should also have a density sufficient to make them substantially rigid, such as approximately 1 to approximately 3 pounds per cubic foot, preferably approximately 1.5 pounds per cubic foot. High density expanded polystyrene is available under the trademark Neopor® and is available from Georgia Foam, Gainesville, Ga. The foam insulating panels 14-22 can be made by molding to the desired size and shape, by cutting blocks or sheets of pre-formed extruded expanded polystyrene into a desired size and shape or by extruding the desired shape and then cutting to the desired length. Although the foam insulating panels 14-22 can be of any desired size, it is specifically contemplated that the panels will be of a length equal to the width of the tilt-up concrete panel. Additional foam insulating panels can then be placed adjacent to the first foam insulating panel and adhesively connected thereto. Any number of foam insulating panels can be joined together to provide a form bottom of a dimension equal to the desired height of the tilt-up concrete panel being formed. However, for ease of handling, the foam insulating panels will generally be about 8 to 16 feet long and about 4 feet wide. If the foam insulating panels are made from a material other than polystyrene, the foam insulating panels should have insulating properties equivalent to at least 1 inch of expanded polystyrene foam; preferably, between 2 and 8 inches of expanded polystyrene foam; especially at least 2 inches of expanded polystyrene foam; more especially at least 3 inches of expanded polystyrene foam; most especially, at least 4 inches of expanded polystyrene foam.

Optionally, applied to the lower (i.e., bottom) surface of each foam insulating panel 14-22 is a layer of reinforcing material 24 (FIG. 16), as disclosed in U.S. Pat. Nos. 8,555,583 and 8,756,890 (both of which are incorporated herein by reference in their entirety). The layer of reinforcing material 24 can be made from continuous materials, such as sheets or films, or discontinuous materials, such as fabrics, webs or meshes. The layer of reinforcing material 24 can be made from materials such as polymers, for example polyethylene or polypropylene, from fibers, such as fiberglass, basalt fibers, aramid fibers or from composite materials, such as carbon fibers in polymeric materials, or from metal sheets, such as steel or aluminum sheets or corrugated sheets, and foils, such as metal foils, especially aluminum foil. The layer of reinforcing material 24 can be adhered to the outer surfaces (i.e., the bottom surface when the panel is in a horizontal position or the exterior surface when the panel is in a vertical position) of the foam insulating panels 14-22 by a conventional adhesive. However, it is preferred that the layer of reinforcing material 24 be laminated to the lower surfaces of the foam insulating panels 14-22 using a polymeric material that also forms a weather or moisture barrier on the exterior surface of the foam insulating panels. The weather barrier can be applied to a layer of reinforcing material 24 on the surface of the foam insulating panels 14-22 by any suitable method, such as by spraying, brushing or rolling The moisture barrier can be applied as the laminating agent for the layer of reinforcing material 24 or it can be applied in addition to an adhesive used to adhere the layer of reinforcing material to the outer surfaces of the foam insulating panels. Suitable polymeric materials for use as the moisture barrier are any water-proof polymeric material that is compatible with both the material from which the layer of reinforcing material and the foam insulating panels are made; especially, liquid applied weather membrane materials. Useful liquid applied weather membrane materials include, but are not limited to, WeatherSeal® by Parex of Anaheim, Calif. (a 100% acrylic elastomeric waterproof membrane and air barrier which can be applied by rolling, brushing, or spraying) or Senershield® by BASF (a one-component fluid-applied vapor impermeable air/water-resistive barrier that is both waterproof and resilient) available at most building supply stores. For relatively simple application, where cost is an issue or where simple exterior finish systems are desired, the layer of reinforcing material can be omitted.

The foam insulating panels 14-22 include a plurality of panel anchor member/locking cap assemblies 26 (FIG. 2), which includes a panel anchor member 28 and a locking cap 30. The panel anchor member/locking cap assembly 26 is preferably formed from a polymeric material, such as polyethylene, polypropylene, nylon, glass filled thermoplastics or the like. For particularly large or heavy structures, the panel anchor member 28 is preferably formed from glass filled nylon. The panel anchor member/locking cap assembly 26 can be formed by any suitable process, such as by injection molding.

Each panel anchor member/locking cap assembly 24 includes two separate pieces: a panel anchor member 28 and a locking cap 30. The panel anchor member 28 (FIG. 3) includes an elongate panel-penetrating portion 32 and an elongate concrete anchor portion 34. The panel-penetrating portion 32 can be any suitable cross-sectional shape, such as square, round, oval or the like, but in this embodiment is shown as having a generally plus sign ("+") cross-sectional shape. The panel-penetrating portion 32 comprises four leg members 34, 36, 38, 40 (FIGS. 3, 4 and 5) extending outwardly from a central core member 41. The plus sign ("+") cross-sectional shape of the panel-penetrating portion 32 prevents the anchor member 26 from rotating around its longitudinal axis during concrete placement. Formed intermediate each end 42, 44 of the anchor member 28 is a central flange 46 that extends outwardly radially from the leg members 34-40. The central flange 46 can be any shape, such as square, oval or the like, but in this embodiment is shown as having a round shape. The central flange 46 includes a generally flat foam insulating panel contacting portion 48 (FIG. 4).

The concrete anchor portion 34 of the anchor member 28 comprises four outwardly extending leg members 50, 52, 54, 56 (FIGS. 3 and 6). Formed at the end of the concrete anchor portion 34 opposite the flange 46 is another flange 58 that extends radially outwardly from the leg members 50-56. The flange 58 can be any suitable shape, such as square, oval or the like, but in this embodiment is shown as circular. The flange 58 prevents the panel anchor member 28 from pulling out of the concrete after it is cured.

Figure 2:
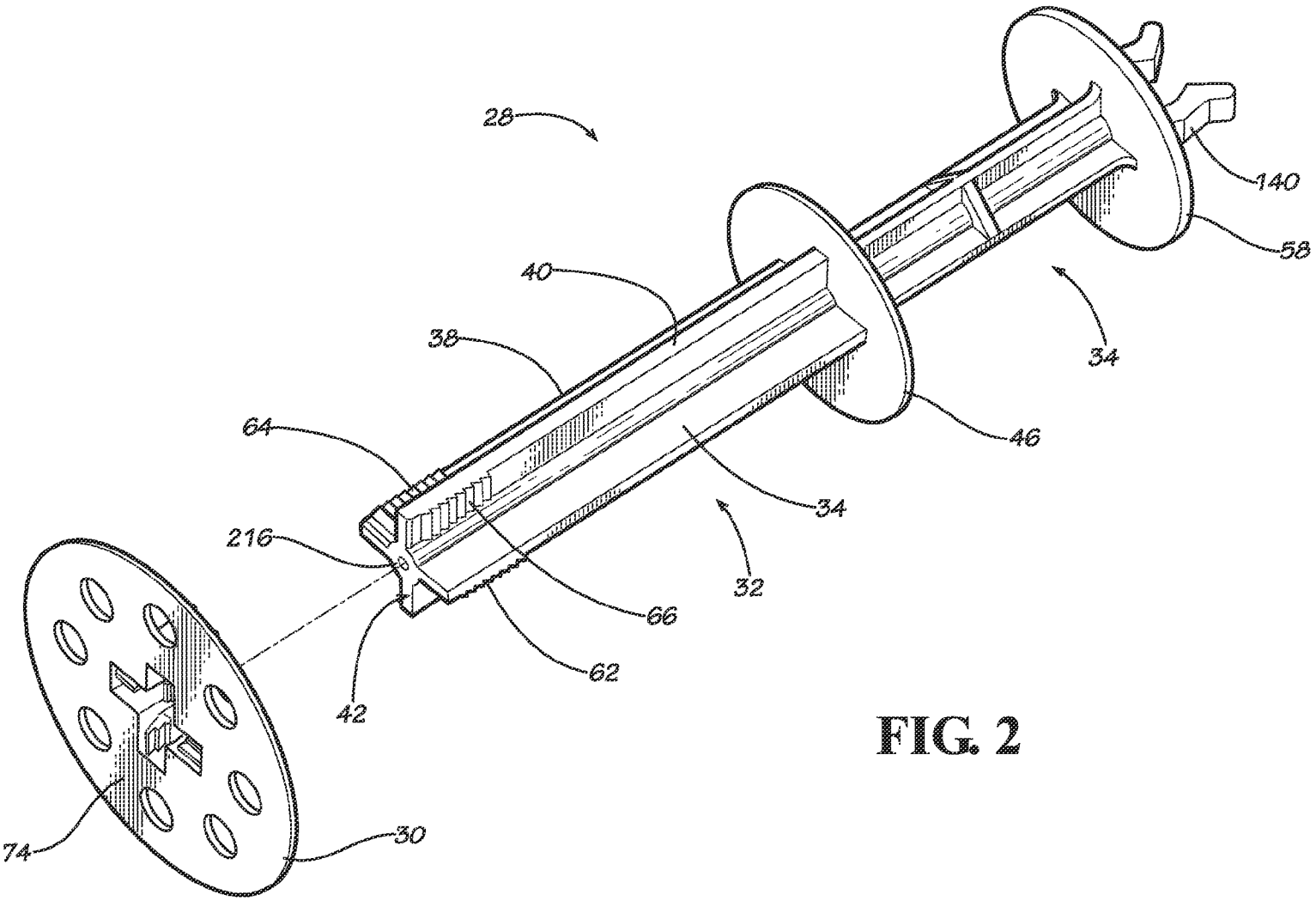
FIG. 2 is an exploded perspective view of an anchor member/locking cap assembly in accordance with the present invention.
Figure 8:
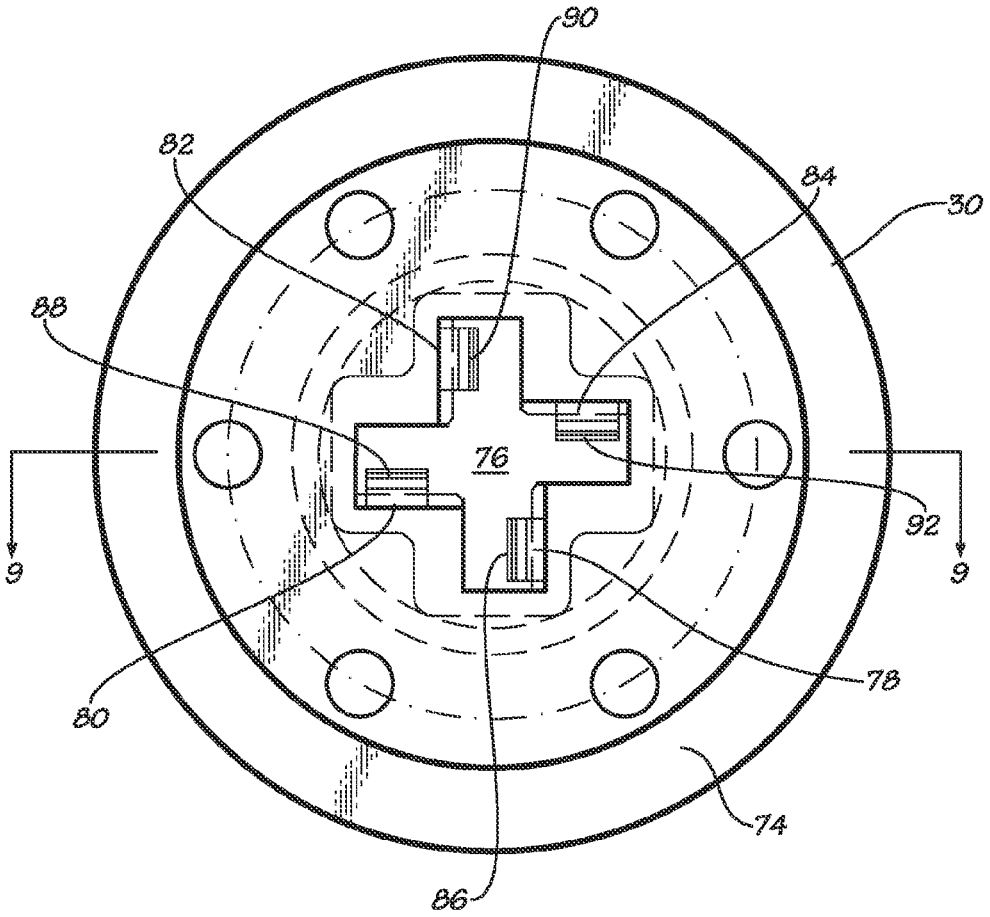
FIG. 8 is a top plan view of the locking caps shown in FIG. 2.
Figure 9:
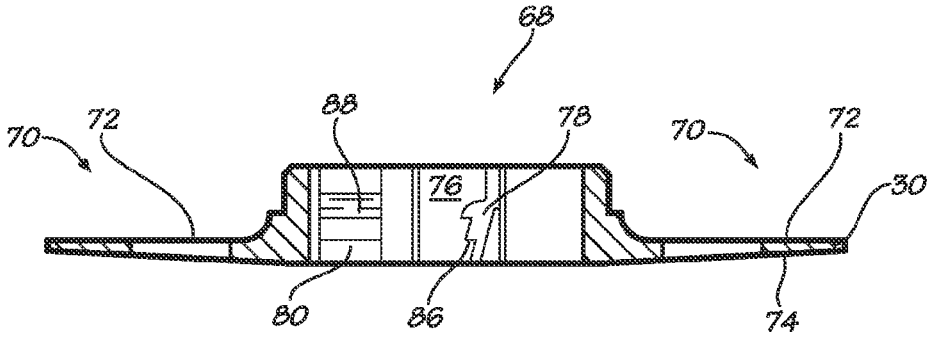
FIG. 9 is a cross-sectional view taken along the line 9-9 of the locking cap shown in FIG. 8.

On each of the legs 34-40 adjacent the end 42 of the panel anchor member 28 is formed a plurality of teeth 60, 62, 64, 66 (FIGS. 2, 3 and 4). The locking cap 30 includes a panel-penetrating receiving portion 68 and a circumferential insulating panel contacting portion 70. The locking cap 30 includes a generally flat foam insulating panel contacting portion 72 (FIGS. 2 and 9) adjacent its circumferential edge and a flat exterior surface 74. The central panel spacer member receiving portion 68 defines an opening 76 for receiving the end 42 of the panel anchor member 28. The opening 76 is sized and shaped such that the four legs 34-40 of the panel penetrating portion 32 will fit through the opening. Formed within the opening 76 are four latch fingers 78, 80, 82, 84. Each latch finder 78-84 includes a plurality of teeth 86, 88, 90, 92, respectively, that are sized and shaped to mate with the teeth 60-66 on the panel anchor member 28. The latch fingers 78-84 are designed so that they can move outwardly; i.e., toward the circumferential portion 70, when the end 42 of the panel anchor member 28 is inserted in the opening 76 of the locking cap 30, but will tend to return to its original position due to the resiliency of the plastic material from which it is made. Thus, as the end 42 of the panel anchor member 30 is inserted into and through the opening 76, the teeth 86-92 will ride over the teeth 60-66. However, once the teeth 86-92 mate with the teeth 60-66 they prevent removal of the panel anchor member 28 from the locking cap 30. The teeth 86-92 and 60-66 therefore provide a one-way locking mechanism; i.e., the locking cap 30 can be relatively easily inserted onto the panel anchor member 28, but once fully inserted, the locking cap is locked in place and cannot be removed from the panel spacer member under normally expected forces.

Figure 16:
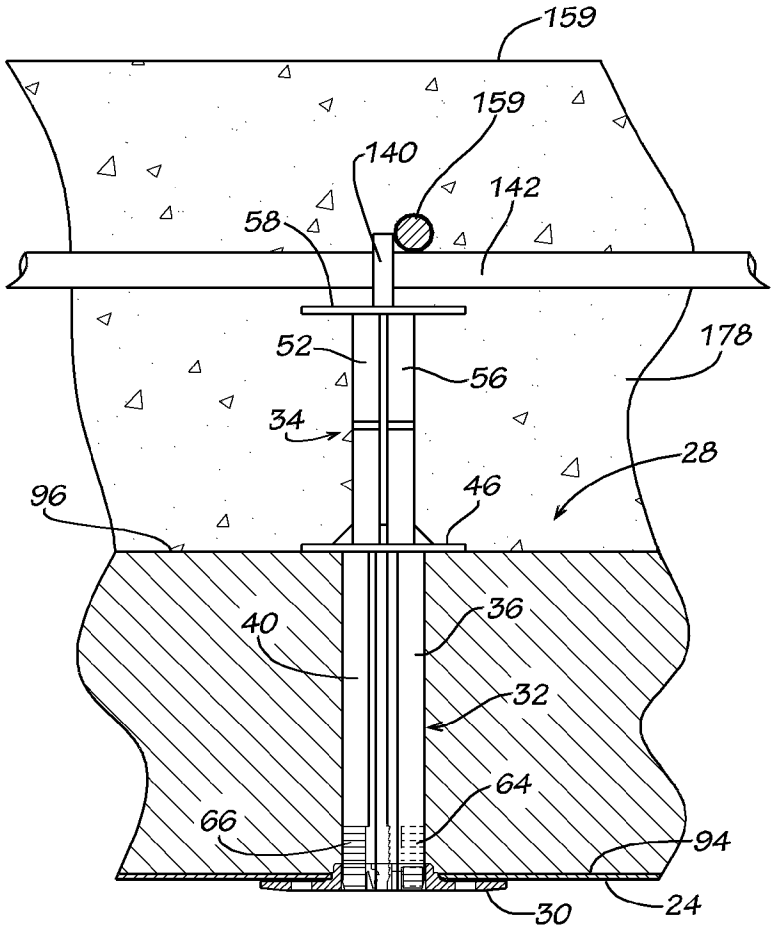
FIG. 16 is a partial detail cross-sectional end view of a portion of the tilt-up insulated concrete panel shown in FIG. 14.
Figure 15:
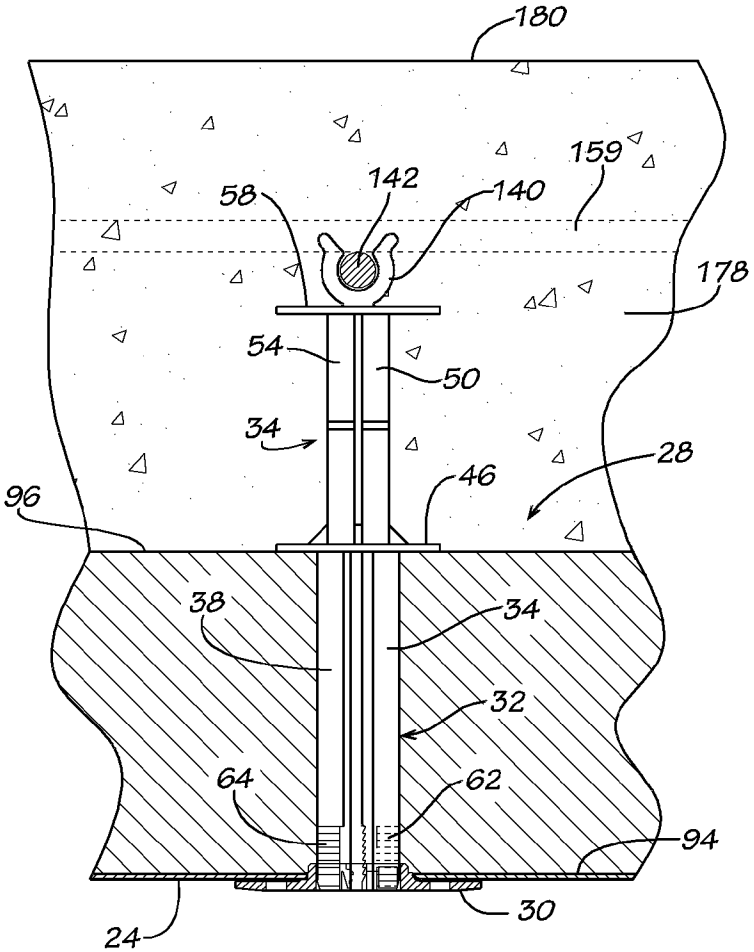
FIG. 15 is a partial detail cross-sectional side view of a portion of the tilt-up insulated concrete panel shown in FIG. 14.
Figure 17:
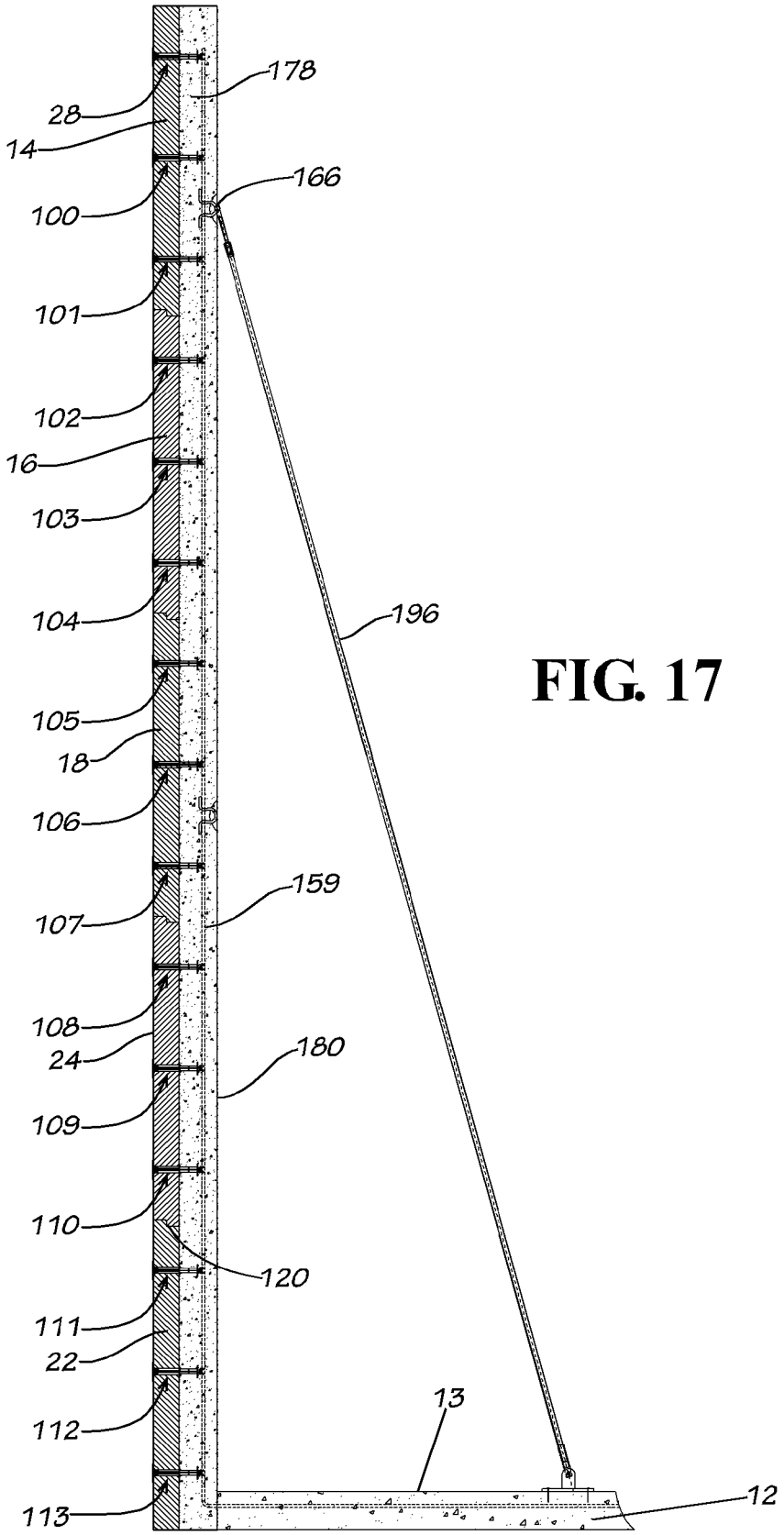
FIG. 17 is a side cross-sectional view of the tilt-up insulated concrete panel shown in FIG. 14 showing the panel in a vertical position with a brace installed.
Figure 18:
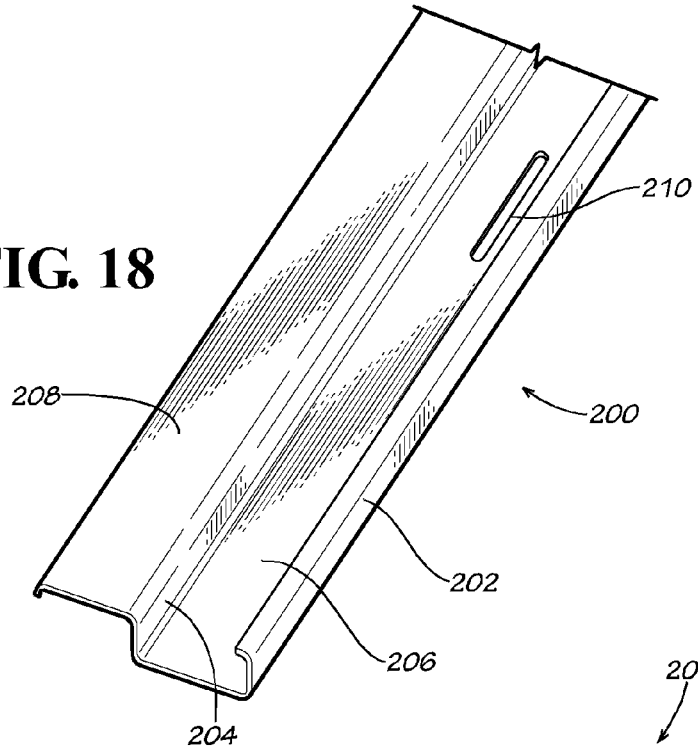
FIG. 18 is a partial perspective view of a disclosed embodiment of a vertical wall stud in accordance with the present invention.
Figure 22:
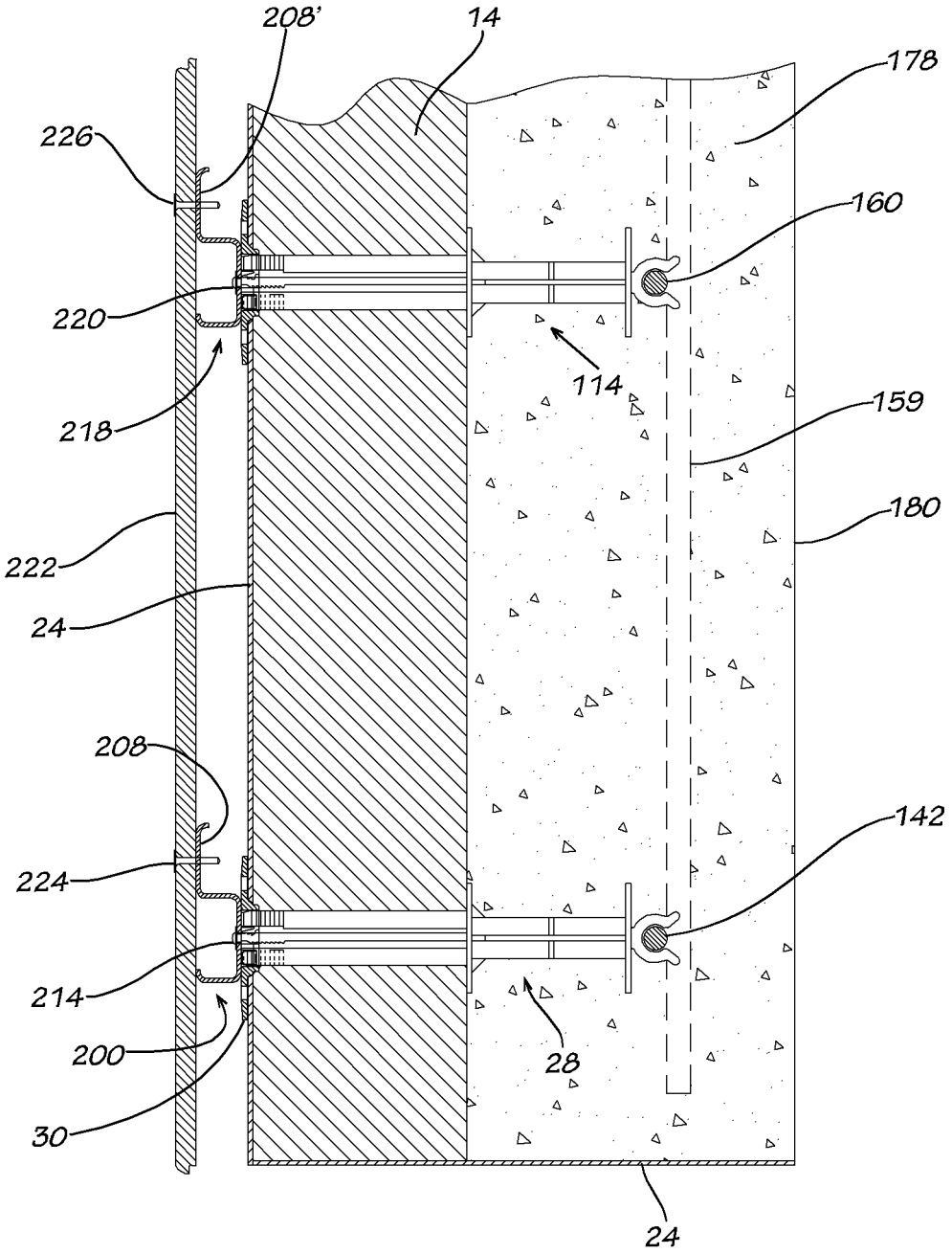
FIG. 22 is a partial detail cross-sectional side view of a portion of the tilt-up insulated concrete panel shown in FIG. 17 showing vertical wall studs, as shown in FIGS. 18-21, attached to the panel anchor members and also showing a piece of exterior wall cladding material attached to the vertical wall studs.

Each of the foam insulating panels 14-22 is prepared by forming a plurality of holes in the foam insulating panels to receive the ends, such as the end 42 of the panel penetrating portion 32, of a plurality of panel anchor members identical to the panel anchor member 28. Holes (not shown) in the composite foam insulating panels 14-22 can be formed by conventional drilling, such as with a rotating drill bit, by water jets or by hot knives. When the composite foam insulating panels 14-22 include a layer of reinforcing material 24 the layer of reinforcing material is preferably adhered to the composite foam insulating panels before the holes are formed in those panels. It is also preferable to form the holes in the composite foam insulating panels 14-22 after the moisture barrier is applied to the bottom surface 94 of each of the composite foam insulating panels. First, in each of the composite foam insulating panels 14-22, round holes are formed through the thickness of the panels extending from the upper surface 96 to the bottom surfaces 94. The inner diameter of the holes is equal to the outer diameter of the central round core 41 of the panel anchor member 28 so as to form a tight fit when the panel-penetrating portion 32 is inserted into each hole. Then, slots (not shown) radiating outwardly from the initial hole and spaced circumferentially 90 degrees from each other are drilled in the composite foam insulating panels 14-22 to accommodate the legs 34-40 of the panel anchor member 28 and to form a tight fit therewith. Alternately, a hole matching the cross-sectional shape of the end 42 of the panel anchor member 28, including the central round core 41 and the legs 34-40, can be formed in the composite foam insulating panels 14-22 using a hot knife. The holes formed in the composite foam insulating panels 14-22 extend from the bottom surface 94 to the upper surface 96, respectively, of the composite foam insulating panels so that the foam panel-penetrating portion 32 of the panel anchor member 28 can be inserted complete through the composite foam insulating panels, as shown in FIGS. 15, 16 and 22.

The foam insulating panels 14-22 are assembled by inserting the foam panel penetrating portion 32 of the panel anchor member 28 through the hole (not shown) in the first foam insulating panel 14, until the panel contacting portion 48 of the flange 46 contacts the top surface 96 of the foam insulating panel and the end 42 of the panel anchor member is flush with the bottom surface 94 of the foam insulating panel (FIGS. 15 and 16) or with the reinforcing layer 24, if present. The locking cap 30 is then attached to the panel anchor member 28 by inserting the end 42 thereof into the opening 76 in the locking cap such that the panel contacting portion 72 thereof contacts the bottom surface 94 of the foam insulating panel (or contacts the reinforcing material 24 on the bottom surface 94, if present). As the panel penetrating portion 32 of the panel anchor member 28 is inserted into the locking cap 30, the latch fingers 78-84 deflect outwardly such that the teeth 62-66 on the legs 34-40 slide over the teeth 86-92 of the latch fingers and permit the locking cap 30 to be slipped onto the panel penetrating portion of the panel anchor member. When the locking cap 30 is fully inserted onto the panel anchor member 28, the teeth 86-92 of the latch fingers 78-84 of the locking cap 30 and the teeth 62-66 on the legs 34-40 mate preventing movement of the locking cap outwardly away from the foam insulating panel 14, thereby locking the locking cap and the panel anchor member 30 together and capturing the foam insulating panel 14 between the flange 46 on the panel anchor member and the locking cap. When the panel contacting surface 48 of the locking cap 30 contacts the bottom surface 94 (or contacts the reinforcing material 24 on the bottom surface 94, if present) of the first foam insulating panel 14, sufficient addition pressure is applied pushing the locking cap and the panel anchor member 28 together such that the foam of the foam insulating panel is compressed slightly thereby providing a tight seal between the panel contacting portion 72 of the locking cap 30 and the panel contacting portion 48 of the flange 46 and the bottom surface 94 (or contacts the reinforcing material 24 on the bottom surface 94, if present) thereby providing a water-proof or substantially water-proof seal. It should be noted that when the layer of reinforcing material 24 is used on the bottom surface 94 of the foam insulating panels 14-22, the layer of reinforcing material 24 will be captured between the panel contacting portion 72 of the locking cap 30 and the bottom surface 94 of the foam insulating panel 14 (see for example FIGS. 15 and 16).

As shown in FIG. 1, a plurality panel anchor members identical to the panel anchor members 28 and mating locking caps 30, are positioned in spaced rows and columns across the width and height of the foam insulating panels 14-22. In the embodiment disclosed herein, the panel anchor members are spaced on 16 inch centers. For example, there is a vertical column of fifteen vertically spaced panel anchor members 28, 100-113 spanning the five foam insulating panels 14-22. Six additional identical columns of panel anchor members are disposed across the width of the foam insulating panels 14-22. There is a row of seven panel anchor members 28, 114-119. Additional panel anchor members are formed into fourteen identical rows of panel anchor members.

The panel anchor member/locking cap assemblies 26 are used to attach the foam insulating panels 14-22 to the concrete panel that will be cast in the insulated concrete form 10. The panel anchor member/locking cap assemblies 26 are also used to optionally attach cladding systems to the exterior surface of the tilt-up concrete panel. The diameter of the locking caps 30 should therefore be as large as practical to maintain the panel anchor member 28 in a vertical position when rebar is attached to the panel anchor member, as described below, and when plastic concrete is placed in the form. It is found as a part of the present invention that locking caps 30 having diameters of approximately 2 to 4 inches, especially approximately 3 inches, are useful in the present invention. The diameter of the flange 58 should therefore be as large as practical to support the anticipated weight of the cladding material that will be attached to the panel anchor member 28. Furthermore, the spacing between adjacent panel anchor member/locking cap assemblies 28, such as between panel anchor members 28, 114-119 (FIG. 1), will vary depending on factors including the type of cladding that may optionally be attached to the panel anchor members. However, depending on the desired type of exterior wall cladding, it is found as a part of the present invention that a spacing of adjacent panel anchor members/locking cap assemblies 26 of approximately 6 inch to 24 inch centers, especially 16 inch centers, is useful in the present invention.

The thickness of the foam insulating panels 14-22 is also a factor that must be considered in designing the insulated concrete form 10 in accordance with the present invention and will vary depending on factors including the amount of insulation desired, the thickness of the concrete panel, and the dimensions of the concrete panel. There is no maximum thickness for the foam insulating panels that can be used in the present invention. The maximum thickness is only dictated by economics and ease of handing. However, it is found as a part of the present invention that the thickness for the foam insulating panels 14-22 useful for the present invention is at least 1 inch; preferably, between approximately 2 and approximately 8 inches; especially at least 2 inches; more especially at least 3 inches; most especially, at least 4 inches.

Use of the present invention will now be considered. It is anticipated that the foam insulating panels 14-22 with the panel anchor member/locking caps assemblies 26 installed in them will be preassembled at a remote location and transported to a job site. The foam insulating panels 14-22 are then place on a flat horizontal surface, such as on the flat surface 13 of the concrete slab 12. Each of the 4 feet by 10 feet foam insulating panels is laid adjacent to each other foam insulating panel on the surface 13 of the concrete slab 12. And, the adjacent edges of the foam insulating panels, such as the joint between the panels 14, 16, is adhered to each other with a water-proof adhesive. The panels 14-22 preferably have a shiplap edge, such as shown in applicant's co-pending patent application Ser. No. 12/753,220 filed Apr. 2, 2010, which is incorporated herein by reference in its entirety. Thus, when the panels 14, 16 are placed side-by-side, a Z-shaped joint (not shown) is formed therebetween. An identical Z-shaped joint 120 is formed between the panels 20, 22, as shown in FIG. 10, and between panels 16, 18 and 18, 20 (Not shown). Before the composite foam insulating panels 14, 16 are joined together, a water-proof adhesive is applied to the longitudinal shiplap edges thereof. Such adhesive can be applied by any conventional means, such as by brushing, rolling, spraying, spreading, and the like. When the foam insulating panels 14, 16 are joined at their longitudinal edges as shown in FIGS. 1 and 10, the adhesive fills the Z-shaped joint formed there between and renders the joint water-proof or substantially water-proof. Any water-proof adhesive suitable for adhering polystyrene to polystyrene, or the specific type of foam used for the foam insulating panels, can be used. One such adhesive is a sprayable polyurethane adhesive that is commercially available under the designation Great Stuff available from Dow Chemicals, Midland, Mich. The longitudinal joints between the panels 16, 18 and 18, 20 and 20, 22 are similarly adhered to each other with the water-proof adhesive.

When all of the foam insulating panels 14-22 are adhered to each other they collectively form a bottom surface of the insulated concrete form 10 and have the exact desired dimensions of the finished tilt-up concrete panel, which in this case is illustrated as being 10 feet by 20 feet. It should be noted that the exterior longitudinal edges 122, 124 of the panels 14, 22, respectively, are flat and do not include the shiplap feature. Similarly, the lateral edges of the panels 14-22, such as the lateral edges 126, 128 (FIG. 11) of the foam insulating panel 14, are flat and do not include the shiplap feature.

Figure 11:
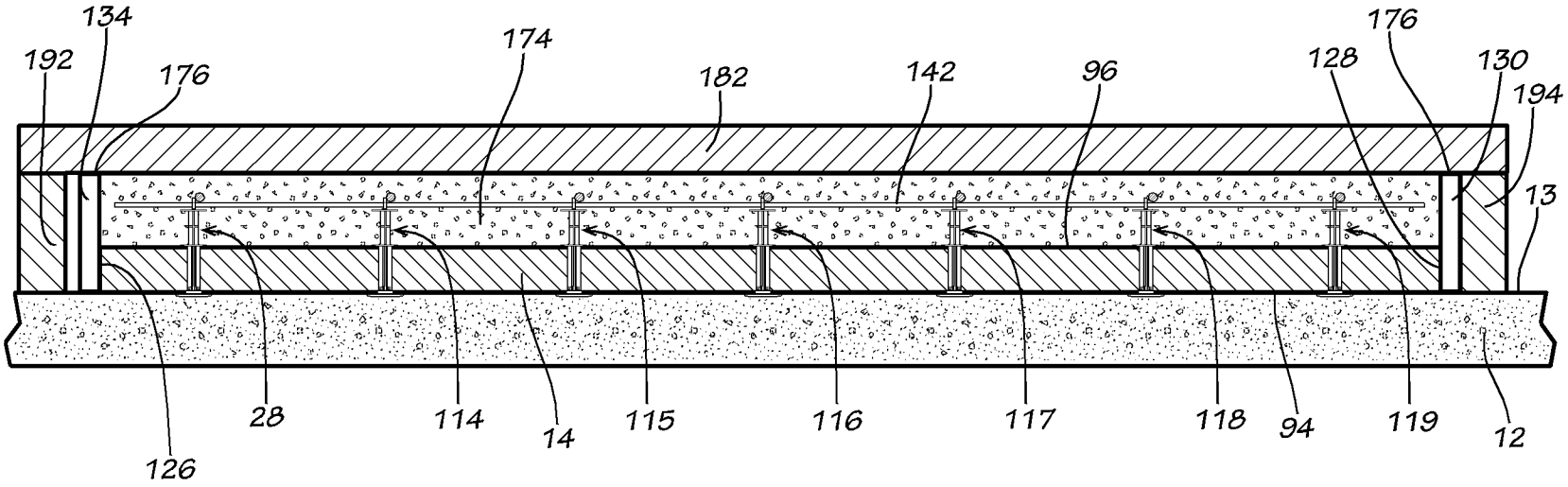
FIG. 11 is a cross-sectional view taken along the line 11-11 of the insulated concrete form shown in FIG. 1 additionally showing concrete in the form and foam insulating panels on the top and sides of the form.

After all of the foam insulating panels 14-22 are adhered to each other as described above, a conventional wood or metal form is constructed around the peripheral edges of the foam insulating panels. Specifically, as shown in FIGS. 1, 10 and 11, a longitudinal form member 130 is disposed against the right lateral exterior edges of the panels 14-22. A transverse form member 132 is disposed against the upper longitudinal exterior edge of the panel 22. A longitudinal form member 134 is disposed against the left lateral exterior edges of the panels 14-22. And, a transverse form member 136 is disposed against the lower longitudinal exterior edge of the panel 22. The side form members 130-136 are joined together in a manner well known in the art. Although this embodiment has been disclosed as adhering the foam insulating panels 14-22 together and then constructing the side frame members 130-136. The present invention also contemplates constructing the side form members first and then adhering the foam insulating panels 14-22 to each other within the side frame members. If the side frame members 130-136 are constructed first, it may be necessary to trim the foam insulating panels 14-22 to fit. This can easily be done with a saw or preferably with a hot knife. The height of the side form members 130-136 is selected such that it is equal to the thickness of the foam insulating panels 14-22 plus the desired thickness of the tilt-up concrete panel. For example, if the foam insulating panels 14-22 are four inches thick and the tilt-up concrete panel is to be six inches thick, the side form members 130-136 will be 10 inches high.

Figure 20:
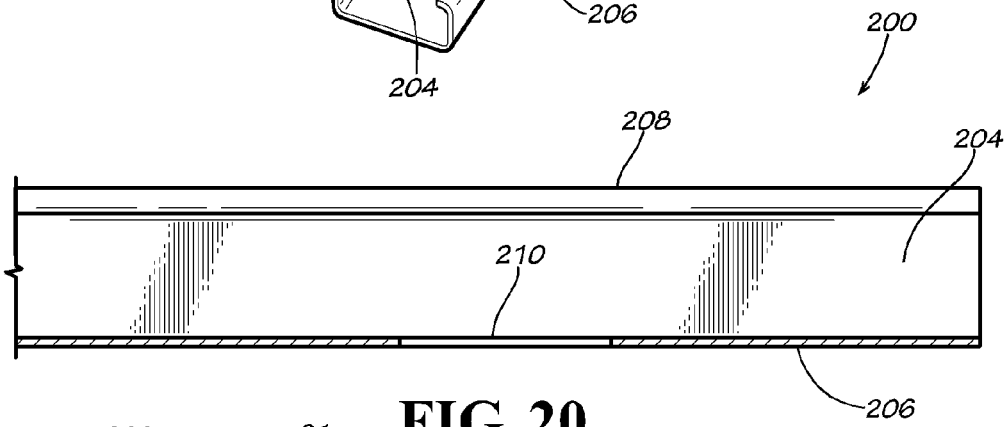
FIG. 20 is partial cross-sectional view taken along the line 20-20 of the vertical wall stud shown in FIG. 19.
Figure 19:
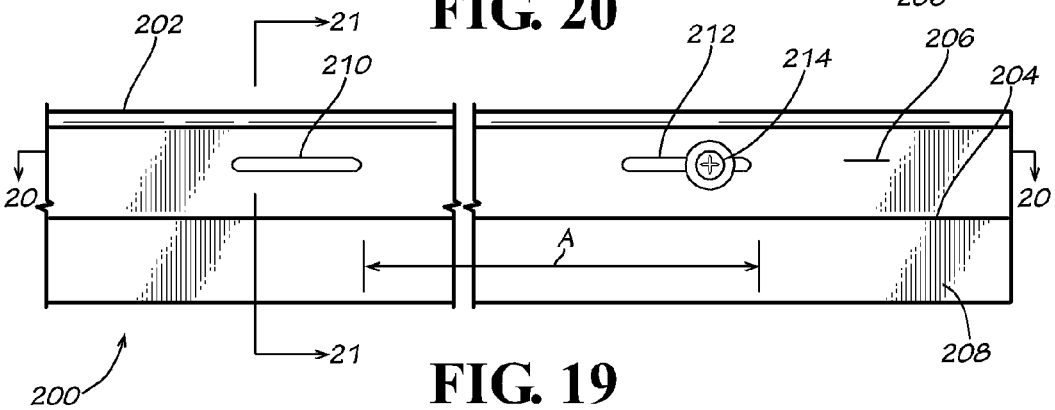
FIG. 19 is a partial top plan view of the vertical wall stud shown in FIG. 18.
Figure 21:
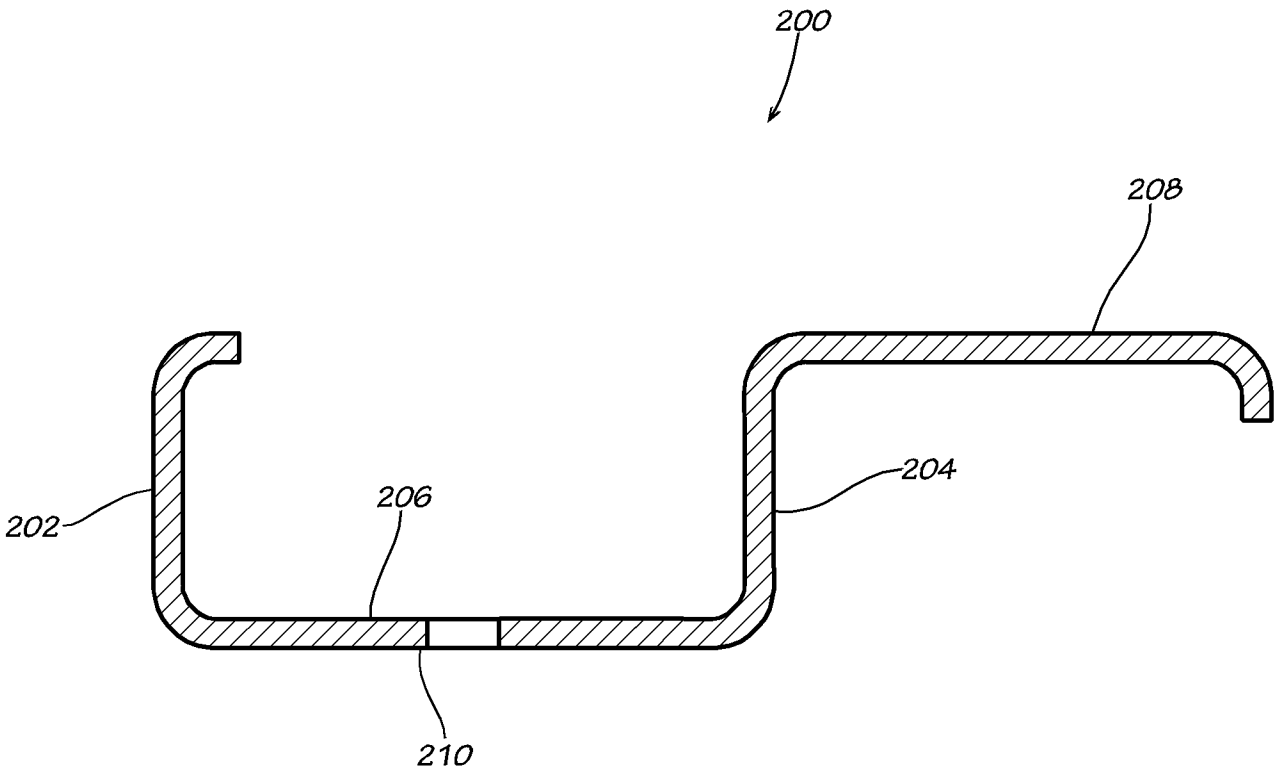
FIG. 21 is cross-sectional view taken along the line 21-21 of the vertical wall stud shown in FIG. 19.

Each of the panel anchor members, such as the panel anchor member 28, includes a C-shaped clamping member 140 extending upwardly from the flange 58. The clamping member 140 is sized and shaped as a rebar chair to receive and retain an elongate round steel rebar, such as the rebar 142. The clamping member 140 has a degree of resilience to it so that the rebar 142 can be pushed into the clamping member and the clamping member will hold the rebar with sufficient force such that the rebar will not be dislodged from the clamping member when plastic concrete is poured into the insulated concrete form 10 and on top of the horizontal foam insulating panels 14-22. The clamping member 140 of the anchor member 28 is aligned with the other clamping members of the other anchor members in the same row of anchor members, such as the row of anchor members 114-119, so that the same piece of rebar 142 can be attached to the clamping members of the anchor members 28, 114-119 (see FIG. 10). Thus, aligned rows of panel anchor members provide aligned rows of clamping members, such that additional rows of rebar parallel to the rebar 142, such as the rebar 143-158, of a desired length can be attached to the rows of panel anchor members. Crossing columns of rebar, such as the rebar 159-165, are laid on top of the rows of rebar, such as the rebar 142-158 to form a conventional rebar grid. Where the columns and rows of rebar intersect, such as the rebar 142, 143 and the rebar 159 (FIG. 20) can be tied together with wire ties (not shown) in any conventional manner known in the art. The panel anchor members, such as the panel anchor member 28, are designed such that the distance from the flange 46 to the C-shaped clamping member 140 will position the rebar, such as the rebar 142 at approximately the mid-point of the thickness of the tilt-up concrete panel. Thus, the panel anchor member will automatically position the rebar grid at the proper depth for the tilt-up concrete panel being constructed, as required by structural design calculations.

Figure 12:
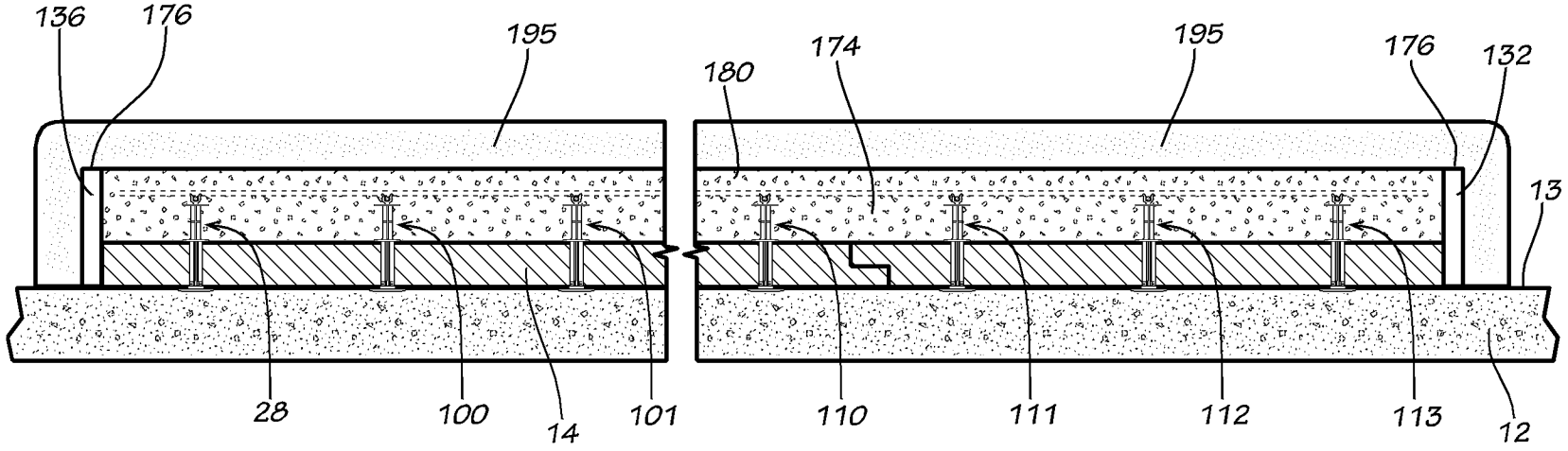
FIG. 12 is a cross-sectional view taken along the line 10-10 of the insulated concrete form shown in FIG. 1 additionally showing concrete in the form and an insulating blanket on the top and sides of the form.

After the rebar grid 142-156 and 159-165 is constructed in the insulated concrete form 10, the form is filled with plastic concrete 174. Sufficient plastic concrete 174 is placed in the form such that the plastic concrete in the form reaches the top 176 of the side form members 130-136. Embeds and/or inserts are attached to the side forms member 13-136 or to the rebar grid, as needed or desired. For example, FIG. 12 shows two lifting hooks 166, 168 in the concrete. The top surface 180 of the plastic concrete 174 is then finished in any desired conventional manner, such as by troweling, or to provide other types of architectural finishes or patterns.

As soon as the plastic concrete in the form has been finished, an insulating material is placed on the top 176 of the side form members 130-136 and the top surface 180 of the finished plastic concrete 174, as shown in FIGS. 10 and 11. The insulating material is preferably made from the same material as the foam insulating panels 14-22 that form the bottom of the insulated concrete form 10. The insulating material on top of the form 10 is preferably made from five separate top foam insulating panels joined together in the same manner as the foam insulating panels 14-22, such as the top foam insulating panels 182, 184, 186, as shown in FIGS. 10 and 11 (only three of the five top foam insulating panels are shown). However, the top foam insulating panels 182-186 are slightly longer and wider than the bottom foam insulating panels 14-22 so that the top foam insulating panels overhang (i.e., extend horizontally outwardly beyond) the side form members 130-136. Narrower side foam insulating panels 188, 190, 192 and 194 are positioned against the side form members 136, 132, 134, 130, respectively, and under the overhanging portions of the top foam insulating panels, such as top foam insulating panels 182, 186. The side foam insulating panels 188-194 are attached to the overhanging portion of the top foam insulating panels, such as the top foam insulating panels 182-186, by any suitable means, such as by an adhesive or by providing a connector, such as a screw, through the top foam insulating panels into the side foam insulating panels. The side foam insulating panels 188-194 can also be attached to the side form members 130-136 by a water-proof adhesive. The top foam insulating panels 182-186 and the side foam insulating panels 188-194 are preferably the same thickness as the bottom foam insulating panels 14-22, or of the same R-value as the bottom panels. If the top and side foam insulating panels are made from a material other than polystyrene, the top and side foam insulating panels should have insulating properties equivalent to at least 1 inch of expanded polystyrene foam; preferably, between approximately 2 and approximately 8 inches of expanded polystyrene foam; especially at least 2 inches of expanded polystyrene foam; more especially at least 3 inches of expanded polystyrene foam; most especially, at least 4 inches of expanded polystyrene foam.

The objective of the present invention is to insulate the plastic concrete 174 within the foam insulating panels/insulating material as completely as possible; i.e., on all sides. As can be seen in FIGS. 10 and 11, the plastic concrete 174 in the insulated concrete form 10 is insulated on both the top and the bottom and on all sides. Thus, the plastic concrete 174 in the form 10 is completely encased or surrounded in insulating material by the bottom foam insulating panels 14-22, the top foam insulating panels 182-186 and the side foam insulating panels 188-194.

Figure 13:
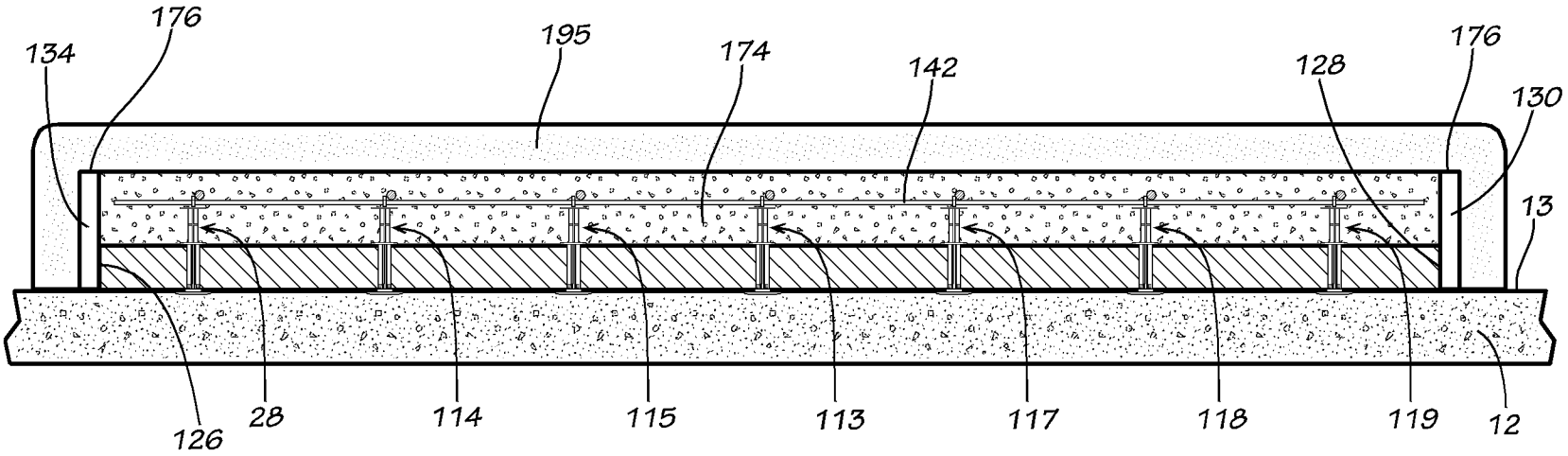
FIG. 13 is a cross-sectional view taken along the line 11-11 of the insulated concrete form shown in FIG. 1 additionally showing concrete in the form and an insulating blanket on the top and sides of the form.
Figure 14:
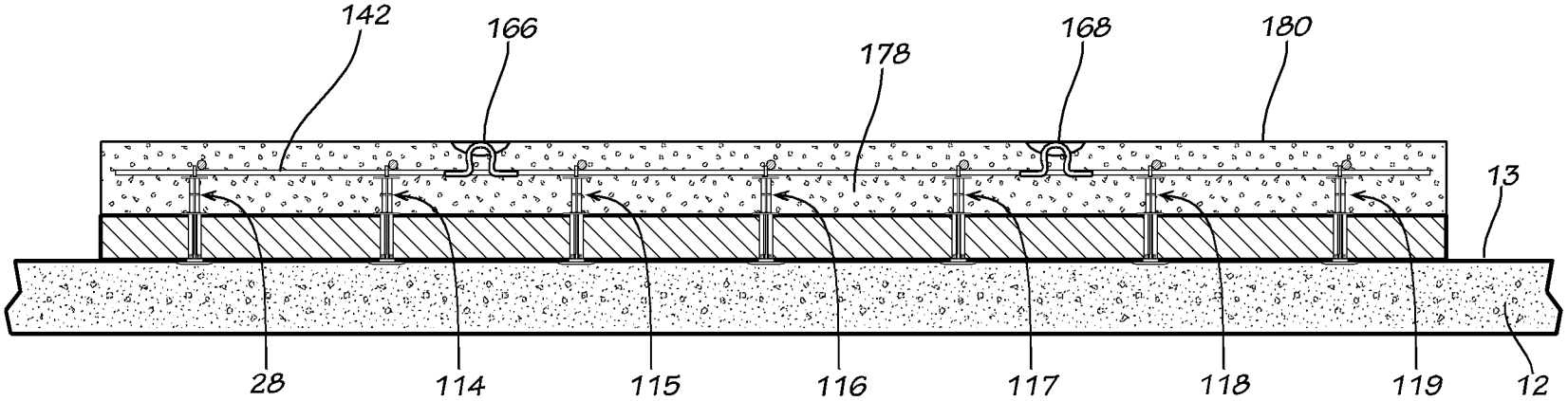
FIG. 14 is a cross-sectional view taken along the line 10-10 of the insulated concrete form shown in FIG. 1 additionally showing concrete with the top and side insulating material and the side forms removed.

In an alternate disclosed embodiment, an insulating blanket 195 may be substituted for the top foam insulating panels 182-186 and the side foam insulating panels 188-194 (FIGS. 12 and 13). The insulating blanket 195 is draped over the top surface 180 of the plastic concrete 174, the tops 176 of the side form members 130-136 and down the sides of the form; i.e., around the side form members 130-136 and down to the surface 13 of the concrete slab 12. Again, the objective is to completely surround the plastic concrete 174 with insulating material. The insulating blanket is typically made from a tarp filled with polyethylene or polypropylene foam. Suitable insulating blankets are commercially available under the designation Micro Foam from Pregis, Lake Forest, Ill. The insulating blanket can also be an electrically heated insulating blanket. Such heated insulating blankets have been used in highway construction in the northern United States to prevent plastic concrete from freezing in winter weather. Suitable electrically heated insulating blankets are commercially available under the designation Powerblanket from Power Blanket LLC, Salt Lake City, Utah Insulating blankets, such as the insulating blanket 195, have advantages over the use of foam insulating panels, such as the foam insulating panels 182-186, in that the insulating blankets are flexible and can be rolled up for easier transportation. An electrically heated blanket also has the advantage to being able to provide additional heat to the curing concrete in order to accelerate the curing process. The insulating blanker (or the electrically heated insulating blanket) should have insulating properties equivalent to at least 1 inch of expanded polystyrene foam; preferably, between approximately 2 and approximately 8 inches of expanded polystyrene foam; especially at least 2 inches of expanded polystyrene foam; more especially at least 3 inches of expanded polystyrene foam; most especially, at least 4 inches of expanded polystyrene foam.

Of course, for certain applications, it may be desirable to omit the use of the insulating material on the top and sides of the form; i.e., omit the use of the top foam insulating panels 182-186 and the side foam insulating panels 188-194 or omit the use of the insulating blanket 195 (or the electrically heated insulating blanket). In other situations, it may be desirable to place an insulating blanket or an electrically heated insulating blanket on top of the top foam insulating panels 182-186 and over the side foam insulating panels 188-194.

The top foam insulating panels 182-186 and the side foam insulating panels 188-194 (or the insulating blanket 195 or electrically heated insulating blanket) are kept on the top and sides of the plastic concrete 174 in the insulated concrete form 10 for a time sufficient for the plastic concrete to achieve sufficient strength, such as sufficient compressive strength, so that the partially cured tilt-up concrete panel can be raised from the horizontal position to a vertical position without breaking or suffering structural damage. The time necessary for the plastic concrete 174 to achieve a desired amount or degree of cure will vary depending on many factors, including the type of concrete mix used, ambient temperatures, thickness of the concrete, and the like. However, the insulating materials can generally be removed from the insulated concrete form 10 after one to seven days. By using the top foam insulating panels 182-186 and the side foam insulating panels 188-194 or the insulating blanket 195 (or the electrically heated insulating blanket) in accordance with the present invention, the plastic concrete in the insulated concrete form 10 will cure faster and will achieve early concrete strength more quickly than prior art systems. The insulated concrete form 10 in accordance with the present invention also results in less plastic concrete shrinkage, thereby reducing cracking of the finished concrete. These benefits make the precast concrete panel in accordance with the present invention stronger and allow the panel to be raised to the vertical position earlier than prior art systems. By retaining the water in the concrete mix within the insulated concrete form and since that space is insulated by the foam insulating panels and/or insulating blanket, the heat of hydration is retained within the insulated concrete form such that the concrete mix will achieve its maximum potential hardness, thereby producing a stronger concrete wall.

After the plastic concrete 174 has achieved a desired amount or degree of cure, the top foam insulating panels 182-186, the side foam insulating panels 188-194 (or the insulating blanket or electrically heated insulating blanket, if used) and the side form members 130-136 are removed, thereby leaving the partially cured tilt-up concrete panel 178 on top of the bottom foam insulating panels 14-22. Since the concrete is at lease partially cured, the panel anchor members, such as the panel anchor members 28, 100-113, 114-119 are securely anchored in the concrete by the flange 58. The bottom foam insulating panels 14-22 are therefore securely attached to the tilt-up concrete panel 178. The tilt-up concrete panel 178, with the foam insulating panels 14-22 attached thereto, is then raised from the horizontal position, as shown if FIG. 12, to the vertical position, as shown in FIG. 15. The tilt-up concrete panel 178 and the foam insulating panels 14-22 are raised to the vertical position using techniques and apparatus that are well known in the art. After the tilt-up concrete panel 178 and the foam insulating panels 14-22 are raised to the vertical position, the tilt-up concrete panel is secured to a plurality of bracing members, such as the bracing member 196. The temporary bracing member 196 is kept in place while other similar tilt-up concrete panels are erected adjacent to the concrete panel 178 and until the roof structural members (not shown) are in place.

The panel anchor members, such as the panel anchor members 28, 100-113, 114-119, not only function for attachment of the foam insulating panels 14-22 to the tilt-up concrete panel 178; they also provide attachment points for vertical walls studs, clips or other attachments used for securing exterior wall cladding. The vertical wall studs allow for the installation of many different types of wall claddings without penetrating the foam, the concrete or the weather membrane. FIGS. 18-21 show a disclosed embodiment of a vertical wall stud 200 in accordance with the present invention. The wall stud 200 comprises an elongate U-shaped channel made from a material having high flexural strength, such as steel or aluminum. The wall stud 200 includes two parallel spaced side members 202, 204 and a connecting bottom member 206. Extending outwardly from the top of the side member 204 is a flange 208. The side members 202, 204 provide extra strength and resistance to flex of the bottom member 206. Formed in the bottom member 206 is an elongated slot 210. The elongated slot 210 can be formed in the wall stud 200 by stamping or any other suitable technique. The wall stud 200 can be formed by extrusion, by roll forming or by any other suitable manufacturing technique.

The length of the wall stud 200 will depend on the height of the tilt-up concrete panel. However, it is contemplated that the length of the wall stud 200 will be equal to the height of the tilt-up concrete panel used in the building being constructed, which in the present case is 20 feet. For ease of transportation, it is also contemplated that two wall studs 20 may be used instead of one longer wall stud. Therefore, in the presently disclosed embodiment two 10 feet long wall studs may be used.

Each of the wall studs 200 will include a plurality of slots identical to the slot 210 longitudinally spaced from each other. For example, a second slot 210 is shown adjacent the slot 210. Also the distance "A" from the slot 210 to the next adjacent slot 212 is the same as the center-to-center distance from one panel anchor member to the next vertically adjacent panel anchor member; e.g., from the panel anchor member 28 to the panel anchor member 100 (FIGS. 1 and 10). Alternately, the distance "A" can be one-half the distance between adjacent panel anchor members; e.g., one-half the distance from the panel anchor member 28 to the panel anchor member 100 (FIGS. 1 and 10). Thus, each wall stud 200 has a plurality of slots, such as the slots 210, 212, spaced along the length thereof and the number and spacing of the slots corresponds to the number and spacing of the vertically aligned panel anchor members, such as the panel anchor members 28, 100-113, used in the foam insulating panels, such as foam insulating panels 14-22, or one-half of that distance.

The wall stud 200 can be attached to the end 42 of the panel anchor member 28 by inserting a pan head self-tapping screw 214 through one of the slots in the wall stud, such as the slot 212, and into a hole 216 (FIGS. 2, 3 and 4) in the end 42 of the panel anchor member 28. The screw 214 can then be tightened so that the wall stud 200 is held firmly in place. It may be desirable to place a pan head washer (not shown) between the screw 214 head and the panel anchor member 28 so as to spread the load over a larger surface area. Similarly, additional screws (not shown) can be inserted into the other slots in the wall stud 200, such as the slot 210, and secured to the other vertically aligned panel anchor members, such as the panel anchor members 100-113. A second wall stud, such as the wall stud 218, can be attached to the next horizontally adjacent column of panel anchor members, such as the panel anchor member 114 (which is identical to the panel anchor member 28), in the same manner as described above for the wall stud 200. Specifically, the wall stud 218 can be attached to the end 42 of the panel anchor member 114 by inserting a self-tapping screw 220 through one of the slots in the wall stud and into a hole 216 (FIGS. 2, 3 and 4) in the end 42 of the panel anchor member 114. The screw 220 can then be tightened so that the wall stud 218 is held firmly in place. It may be desirable to place a washer (not shown) between the screw head 220 and the panel anchor member 114 so as to spread the load over a larger surface area. Similarly, additional screws (not shown) can be inserted into the other slots (not shown) in the wall stud 218 and secured to the other panel anchor members vertically aligned with the panel anchor member 114. An exterior wall cladding member, such as the member 222, can be attached to the vertical wall studs, such as the vertical wall studs 200, 218 by securing a screw or other fastening member, such as the screws 224, 226 through the wall cladding member 222 and into the flanges 208, 208' of each of the vertical wall studs. The wall cladding member 222 can be any suitable exterior wall cladding, such as metal panels, wood siding, composite siding, stone panels, stucco or other types of exterior wall cladding.

Figure 23:
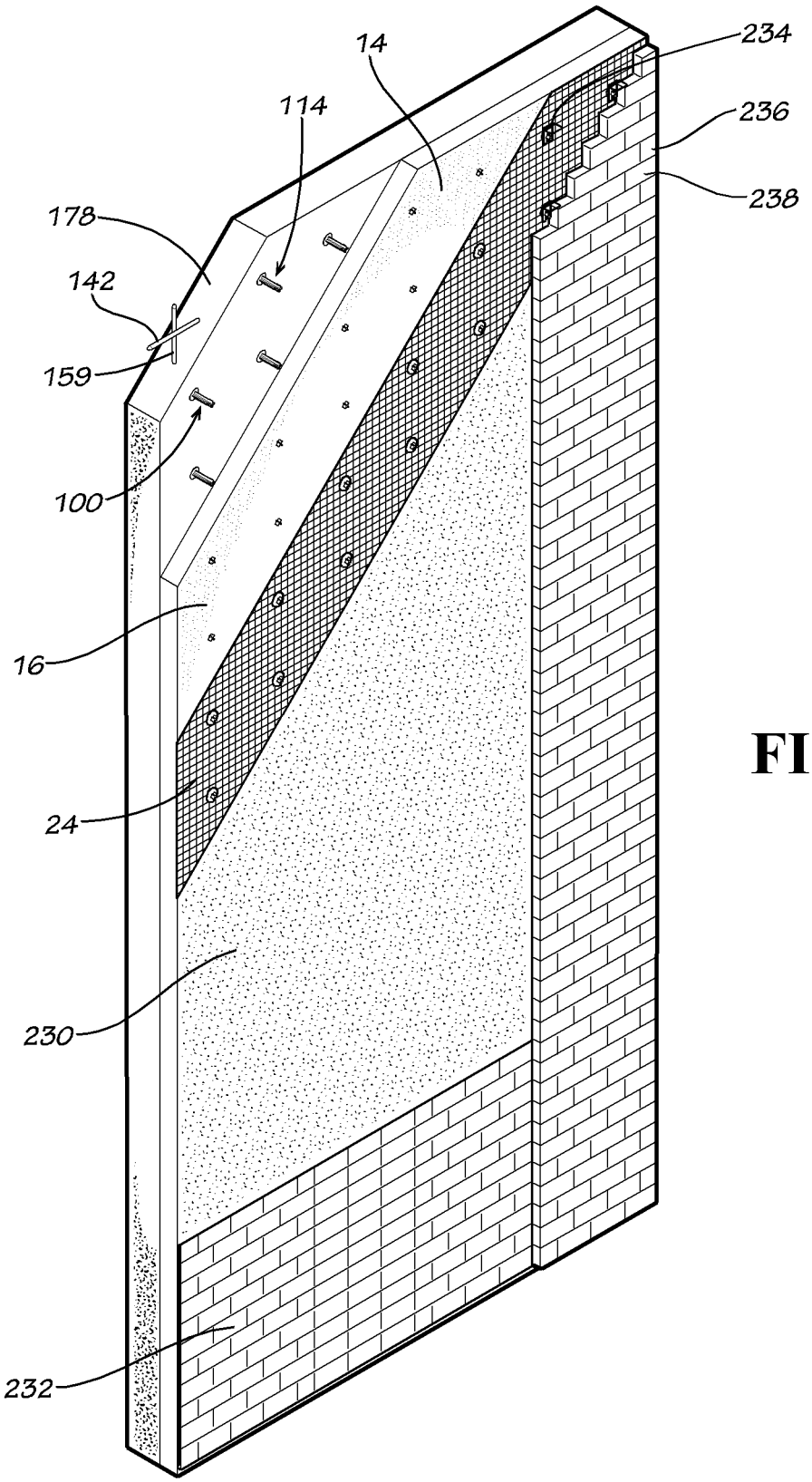
FIG. 23 is a partially broken away perspective view of an alternate disclosed embodiment of an tilt-up insulated concrete wall panel in accordance with the present invention showing a variety of possible exterior wall finishes and wall claddings.

If it is desired to use an exterior finish for the tilt-up concrete panel 178 different from that shown in FIG. 22, the vertical wall studs can be omitted. The tilt-up concrete panel 178 can then be finished with several different exterior wall finishes (FIG. 23). For example, stucco 230 can be applied directly to the layer of reinforcing material 24 on the exterior surface of the foam insulating panels 14-22. Alternately, thin bricks 232 can be adhesively applied directly to the layer of reinforcing material 24 on the exterior surface of the foam insulating panels 14-22. If full size brick are desired as the exterior finish, clips, such as the clip 234 can be attached to the panel anchor members by placing a self-tapping screw (not shown) through a hole or slot (not shown) in the clip 234 and screwing the screw into the hole 216 in the end 42 of the panel anchor members, such as the panel anchor member 28. A wire loop (not shown) attached to the clip 234 is then embedded in mortar between adjacent rows of brick, such as the rows of brick 236, 238.

The insulated concrete forms of the present invention can be used to form precast structures and tilt-up concrete panels for exterior walls of buildings, load-bearing interior walls, columns, piers, parking deck slabs, elevated slab, roofs and other similar precast structures. However, the vast majority of tilt-up concrete is used to construct exterior walls. Additionally, the insulated concrete forms of the present invention can be used to form precast structures including, but not limited to, walls, floors, decking, beams, railings, pipe, vaults, underwater infrastructure, modular paving products, retaining walls, storm water management products, culverts, bridge systems, railroad ties, traffic barriers, tunnel segments, light pole beams, light pole bases, transformer pads, and the like. Precast concrete structures are usually prepared by casting concrete in a reusable mold or form. Thus, the present invention also includes providing insulating material on all external surfaces of precast molds or forms, so that the precast plastic concrete is completely surrounded by insulating material. The insulating material should have insulating properties equal to at least 1 inch of expanded polystyrene foam; preferably, between 2 and 8 inches of expanded polystyrene foam; especially at least 2 inches of expanded polystyrene foam; more especially at least 3 inches of expanded polystyrene foam; most especially, at least 4 inches of expanded polystyrene foam. The insulating material can be in the form of preformed panels or sheets that can be attached to the exterior surfaces of the reusable molds or forms for precast concrete, such as by using a water-proof adhesive. Alternatively, the insulating material can be sprayed on the exterior surface of the reusable molds or forms for precast concrete in liquid form and then foamed in situ, such as by including a blowing agent in the liquid, such as a low-boiling liquid. Polymers that can be sprayed on in liquid form and then foamed in situ include, but are not limited to, polystyrene, polyurethane and other polymers well know to those skilled in the art. Alternatively, the form or mold can be made from a material having insulating properties equal to at least 1 inch of expanded polystyrene foam; preferably, between approximately 2 and approximately 8 inches of expanded polystyrene foam; especially at least 2 inches of expanded polystyrene foam; more especially at least 3 inches of expanded polystyrene foam; most especially, at least 4 inches of expanded polystyrene foam. Therefore, instead of making the precast form or mold from wood or metal, the form can be made from a rigid polymer or a rigid polymer foam, such as foams or solid polymers of polyurethane, polyisocyanurate, epoxy resin and the like. Depending on the application, it may be desirable to include reinforcement in the polymer or polymer foam, such as fiberglass or carbon fibers. Alternately, the form or mold for the precast concrete can be completely surrounded by an insulating blanket or an electrically heated insulating blanket. The insulating blanket, or electrically heated insulating blanket, should have insulating properties equal to at least 1 inch of expanded polystyrene foam; preferably, between approximately 2 and approximately 8 inches of expanded polystyrene foam; especially at least 2 inches of expanded polystyrene foam; more especially at least 3 inches of expanded polystyrene foam; most especially, at least 4 inches of expanded polystyrene foam. Alternately, the form or mold for the precast concrete can be partially surrounded by insulting foam and the remainder of the form or mold for the precast concrete surrounded by an insulating blanket or electrically heated insulating blanket. Alternately, the form or mold for the precast concrete can be completely surrounded by insulating foam and the insulating foam either partially or completely surrounded by insulating blanket or electrically heated insulating blanket.

It should be understood, of course, that the foregoing relates only to certain disclosed embodiments of the present invention and that numerous modifications or alterations may be made therein without departing from the spirit and scope of the invention as set forth in the appended claims.

What is claimed is:

1. A method comprising:

placing an insulated concrete form panel on a horizontal surface, the insulated form panel comprising:

a foam insulating panel having a first primary surface and an opposite second primary surface;

an elastomeric material substantially covering the second primary surface of the foam insulating panel;

a layer of reinforcing material substantially covering the second primary surface of the foam insulating panel and at least partially embedded in the elastomeric material, wherein the layer of reinforcing material is discontinuous;

an elongate anchor member having a first end and an opposite second end, a first portion of the anchor member penetrating the foam insulating panel from the first primary surface to the second primary surface, a second portion of the anchor member extending outwardly from the first primary surface of the foam insulating panel; and an enlarged portion on the first end of the anchor member, such that at least a portion of the layer of reinforcing material and at least a portion of the elastomeric material are disposed between the enlarged portion and the second primary surface of the foam insulating panel.

2. The method of claim 1 further comprising placing a quantity of plastic concrete on the first primary surface of the foam insulating panel, such that the second end of the elongate anchor member is embedded in the quantity of plastic concrete.

3. The method of claim 2 further comprising placing a layer of insulating material on top of the quantity of plastic concrete.

4. The method of claim 3 further comprising:

allowing the plastic concrete to at least partially cure; and raising the insulated concrete form panel and attached concrete to a vertical position.

5. The method of claim 4 further comprising applying an exterior finish to the layer of reinforcing material.

6. The method of claim 4 further comprising applying a layer of stucco to the layer of reinforcing material.

7. The method of claim 4 further comprising adhesively attaching thin brick to the layer of reinforcing material.

8. The method of claim 1, wherein the layer of reinforcing material comprises a fabric, a web or a mesh.

9. The method of claim 1, wherein the layer of reinforcing material is a fiberglass mesh.

10. The method of claim 3, wherein the foam insulating panel has insulating properties equivalent to at least 1 inch of expanded polystyrene foam.

11. The method of claim 10, wherein the layer of insulating material has insulating properties equivalent to at least 1 inch of expanded polystyrene foam.

12. A method comprising:

placing an insulated concrete form panel on a horizontal surface, the insulated form panel comprising:

an expanded polystyrene foam insulating panel having a first primary surface and a second primary surface;

an elastomeric material substantially covering the second primary surface of the expanded polystyrene foam insulating panel;

a layer of reinforcing material substantially covering the second primary surface of the expanded polystyrene foam insulating and at least partially embedded in the elastomeric material, wherein the layer of reinforcing material is discontinuous;

an elongate anchor member having a first end and an opposite second end, a first portion of the anchor member penetrating the expanded polystyrene foam insulating panel from the first primary surface to the second primary surface thereof, a second portion of the anchor member extending outwardly from the first primary surface of the expanded polystyrene foam insulating panel; and a cap member on the first end of the anchor member, whereby at least a portion of the layer of reinforcing material and at least a portion of the elastomeric material are disposed between the cap member and the second primary surface of the expanded polystyrene foam insulating panel.

13. The method of claim 12 further comprising placing a quantity of plastic concrete on the first primary surface of the foam insulating panel, such that the second end of the elongate anchor member is embedded in the quantity of plastic concrete.

14. The method of claim 13 further comprising placing a layer of insulating material on top of the quantity of plastic concrete.

15. The method of claim 14 further comprising:

allowing the plastic concrete to at least partially cure; and raising the insulated concrete form panel and attached concrete to a vertical position.

16. The method of claim 15 further comprising applying an exterior finish to the layer of reinforcing material.

17. The method of claim 15 further comprising applying a layer of stucco to the layer of reinforcing material.

18. The method of claim 15 further comprising adhesively attaching thin brick to the layer of reinforcing material.

19. The method of claim 12, wherein the layer of reinforcing material comprises a fabric, a web or a mesh.

20. The method of claim 12, wherein the layer of reinforcing material is a fiberglass mesh.

21. The method of claim 12, wherein the expanded polystyrene foam insulating panel has insulating properties equivalent to at least 1 inch of expanded polystyrene foam.

* * * * *